US009908737B2

(12) United States Patent
Chastain et al.

(10) Patent No.: US 9,908,737 B2
(45) Date of Patent: Mar. 6, 2018

(54) CABLE REEL AND REEL CARRYING CADDY

(71) Applicant: PerfectVision Manufacturing, Inc., North Little Rock, AR (US)

(72) Inventors: Robert J. Chastain, Maumelle, AR (US); Denton McDonald, Searcy, AR (US); James S. Carter, Denver, CO (US); Chrispin A. Bowen, Little Rock, AR (US); David A. Kelly, Alexander, AR (US); Glen David Shaw, Conway, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 707 days.

(21) Appl. No.: 13/646,217

(22) Filed: Oct. 5, 2012

(65) Prior Publication Data

US 2013/0087652 A1 Apr. 11, 2013

Related U.S. Application Data

(60) Provisional application No. 61/627,261, filed on Oct. 7, 2011.

(51) Int. Cl.
*B65H 49/20* (2006.01)
*B65H 49/32* (2006.01)
(Continued)

(52) U.S. Cl.
CPC ..... *B65H 49/205* (2013.01); *B65H 49/322* (2013.01); *B65H 49/325* (2013.01);
(Continued)

(58) Field of Classification Search
CPC .... B65H 49/32; B65H 49/322; B65H 49/185; B65H 49/205; B65H 49/325; B65H 49/328; B65H 2701/534
(Continued)

(56) References Cited

U.S. PATENT DOCUMENTS 922,695 A * 5/1909 Haas ..... 206/308
1,311,758 A * 7/1919 Cowan, Jr. ..... 242/594.2
(Continued)

FOREIGN PATENT DOCUMENTS

EP 0542102 5/1993
WO WO 09014697 11/1990
(Continued)

*Primary Examiner* — Michael E Gallion
(74) *Attorney, Agent, or Firm* — Paul D. Chancellor; Ocean Law

(57) ABSTRACT

A resilient cable caddy comprising a portable housing for storing reels of cable that has a lower base with a hinged top forming an enclosure for the reel. A reel of cable is rotatably mounted within the interior. A handle formed by abutting base and top portions enables carrying. Each reel comprises a spool with a central axle coupled at each end to spaced apart end caps, being retained by mounting rings. The spindles have bearing rings journalled to bearing races defined in the end caps. Both spindles comprise hubs disposed within case gudgeons. A two-piece spindle has a removable hub portion fitted to an internal socket. When reels are transported they may be stacked vertically atop one another with the one piece spindle engaging the empty and exposed spindle hub socket of an upper reel. Caddies may also be opened and stacked vertically for transportation.

24 Claims, 27 Drawing Sheets

(51) Int. Cl.
*B65H 75/18* (2006.01)
*B65H 75/30* (2006.01)

(52) U.S. Cl.
CPC ..... *B65H 49/328* (2013.01); *B65H 75/185* (2013.01); *B65H 75/30* (2013.01); *B65H 2701/534* (2013.01)

(58) Field of Classification Search
USPC ... 242/588, 588.3, 588.6, 599, 599.3, 599.4, 242/608, 608.2, 608.5, 608.6, 609, 609.1, 242/609.3; 206/389
See application file for complete search history.

(56) References Cited

U.S. PATENT DOCUMENTS 2,280,728 A 4/1942 Streib
2,310,522 A * 2/1943 Gorbatenko ..... 83/630
D148,897 S 3/1948 Ward
2,757,351 A 7/1956 Klostermann
D181,302 S 10/1957 Logan
2,858,358 A 10/1958 Hawke
3,150,769 A * 9/1964 Cohn ..... B65D 85/04 220/642
3,184,706 A 5/1965 Atkins
3,199,061 A 8/1965 Johnson
3,292,136 A 12/1966 Somerset
3,332,052 A 7/1967 Rusinyak
3,373,243 A 3/1968 Janowiak
3,375,485 A 3/1968 Donohue
3,412,847 A * 11/1968 Wise et al. ..... 242/588.4
3,446,343 A * 5/1969 Van Rooij et al. ..... 242/588.6
3,448,430 A 6/1969 Kelly
3,498,647 A 3/1970 Schroder
3,512,224 A 5/1970 Newton
3,522,576 A 8/1970 Cairns
3,537,065 A 10/1970 Winston
3,609,637 A 9/1971 Cole
3,665,371 A 5/1972 Cripps
3,668,612 A 6/1972 Nepovim
3,671,922 A 6/1972 Zerlin
3,671,926 A 6/1972 Nepovim
3,677,498 A * 7/1972 Johnson et al. ..... 242/413
3,678,445 A 7/1972 Brancaleone
3,678,446 A 7/1972 Siebelist
3,681,739 A 8/1972 Kornick
3,686,623 A 8/1972 Nijman
3,693,784 A * 9/1972 Holmes ..... B65D 85/04 206/409
3,696,697 A * 10/1972 Hoffman ..... 83/649
3,698,548 A * 10/1972 Stenzel et al. ..... 242/588.4
3,710,005 A 1/1973 French
3,739,076 A 6/1973 Schwartz
3,740,453 A 6/1973 Callaghan
3,835,442 A 9/1974 Arnold
3,835,443 A 9/1974 Arnold
3,840,193 A * 10/1974 Feichtinger et al. ..... 242/597.3
3,846,738 A 11/1974 Nepovim
3,879,102 A 4/1975 Horak
3,976,352 A 8/1976 Spinner
D241,341 S 9/1976 Oxley
3,985,418 A 10/1976 Spinner
3,986,737 A 10/1976 Krusche
4,007,886 A * 2/1977 Kaminstein ..... 242/486.8
4,010,914 A * 3/1977 Kowalski ..... B65H 49/327 242/129.62
4,106,839 A 8/1978 Cooper
4,128,293 A 12/1978 Paoli
4,280,749 A 7/1981 Hemmer
4,329,540 A 5/1982 Howarth
4,330,166 A 5/1982 Cooper
4,423,919 A 1/1984 Hillis
4,426,127 A 1/1984 Kubota
4,440,357 A * 4/1984 Vaughan ..... 242/599.4
4,444,313 A * 4/1984 Tyson ..... B65H 75/185 206/397
4,525,000 A 6/1985 Bachle
4,531,805 A 7/1985 Werth
4,541,586 A * 9/1985 Crowe ..... B65H 49/32 242/129.5
4,582,198 A * 4/1986 Ditton ..... B65D 5/443 206/389
4,583,811 A 4/1986 McMills
4,593,964 A 6/1986 Forney, Jr.
4,630,806 A 12/1986 Dan
4,648,684 A 3/1987 Mattis
4,684,201 A 8/1987 Hutter
4,698,028 A 10/1987 Caro
4,703,988 A 11/1987 Raux
4,746,305 A 5/1988 Nomura
RE32,787 E 11/1988 Gallusser
4,808,128 A 2/1989 Werth
4,813,716 A 3/1989 Lalikos
4,834,675 A 5/1989 Samchisen
4,936,788 A 6/1990 Lin
4,952,174 A 8/1990 Sucht
4,956,908 A * 9/1990 Morse et al. ..... 29/438
D313,222 S 12/1990 Takizawa
4,979,911 A 12/1990 Spencer
4,990,106 A 2/1991 Szegda
5,002,503 A 3/1991 Campbell
5,011,422 A 4/1991 Yeh
5,024,606 A 6/1991 Ming
5,043,696 A 8/1991 Wang
5,066,248 A 11/1991 Gaver, Jr.
5,078,623 A 1/1992 Wang
5,083,943 A 1/1992 Tarrant
5,088,936 A 2/1992 Wang
5,112,250 A 5/1992 Wang
5,114,091 A * 5/1992 Peterson et al. ..... 242/378.3
D327,872 S 7/1992 McMills
D330,329 S * 10/1992 Brightbill ..... D3/302
5,167,525 A 12/1992 Wang
5,167,536 A 12/1992 Wang
5,192,226 A 3/1993 Wang
5,219,299 A 6/1993 Wang
5,224,662 A * 7/1993 Kaussen ..... B65H 49/26 242/129.51
5,226,838 A 7/1993 Hsu
D339,568 S 9/1993 Salz
5,248,108 A * 9/1993 Zander ..... 242/348.3
5,251,841 A * 10/1993 Takatori et al. ..... 242/348
5,261,623 A * 11/1993 Dominesey ..... B65H 16/00 242/348.3
5,270,487 A 12/1993 Sawamura
5,321,207 A 6/1994 Huang
5,340,325 A 8/1994 Pai
5,342,096 A 8/1994 Bachle
5,383,798 A 1/1995 Lin
5,387,116 A 2/1995 Wang
5,387,127 A 2/1995 Wang
5,389,012 A 2/1995 Huang
5,397,252 A 3/1995 Wang
5,407,144 A * 4/1995 Ryall ..... 242/295
5,413,502 A 5/1995 Wang
5,430,618 A 7/1995 Huang
5,438,251 A 8/1995 Chen
5,470,257 A 11/1995 Szegda
5,478,258 A 12/1995 Wang
5,484,082 A * 1/1996 Casper ..... B65D 85/672 206/395
5,498,175 A 3/1996 Yeh
5,522,561 A * 6/1996 Koyamatsu ..... B65H 55/043 206/409
5,599,198 A 2/1997 Wang
5,600,094 A 2/1997 McCabe
5,632,651 A 5/1997 Szegda
5,831,880 A 5/1997 Houlihan
D381,512 S * 7/1997 Green ..... D3/294
5,660,354 A * 8/1997 Ripplinger ..... 242/608
5,667,409 A 9/1997 Wong
5,669,574 A * 9/1997 Calhoun ..... 242/395
5,683,263 A 11/1997 Hsu

(56) References Cited

U.S. PATENT DOCUMENTS 5,702,261 A 12/1997 Wang
5,704,479 A * 1/1998 Barnett et al. ..... 206/395
5,722,856 A 3/1998 Fuchs
5,723,818 A 3/1998 Yeh
5,725,321 A * 3/1998 Brannan et al. ..... 400/708
5,730,621 A 3/1998 Wang
5,769,652 A 6/1998 Wider
5,803,757 A 9/1998 Wang
5,820,408 A 10/1998 Wang
5,863,226 A 1/1999 Lan
5,879,166 A 3/1999 Wang
5,924,889 A 7/1999 Wang
5,934,137 A 8/1999 Tarpill
5,951,319 A 9/1999 Lin
5,957,730 A 9/1999 Wang
5,967,451 A * 10/1999 Radaios ..... 242/594.2
5,975,949 A 11/1999 Holliday
5,975,951 A 11/1999 Burris
5,980,308 A 11/1999 Hu
5,988,561 A * 11/1999 Mele ..... A47K 10/40 242/599.1
5,997,350 A 12/1999 Burris
6,024,588 A 2/2000 Hsu
6,045,087 A * 4/2000 Vislocky et al. ..... 242/608.6
6,065,699 A * 5/2000 Sacconi ..... A01K 89/033 242/286
6,065,976 A 5/2000 Wang
6,095,869 A 8/2000 Wang
6,113,431 A 9/2000 Wong
6,139,344 A 10/2000 Wang
6,145,780 A * 11/2000 Fontana ..... B65H 49/24 242/400
6,146,197 A 11/2000 Holliday
6,153,830 A 11/2000 Montena
6,159,046 A 12/2000 Wong
6,164,588 A * 12/2000 Jacobsen ..... 242/610.4
D436,076 S 1/2001 Montena
6,179,656 B1 1/2001 Wong
D437,826 S 2/2001 Montena
D440,539 S 4/2001 Montena
D440,939 S 4/2001 Montena
6,234,421 B1 * 5/2001 Cox et al. ..... 242/608.8
6,234,838 B1 5/2001 Wong
6,276,623 B1 * 8/2001 Williams ..... B65H 57/12 206/395
6,276,970 B1 8/2001 Wong
6,287,148 B1 9/2001 Huang
D448,565 S * 10/2001 Sanderson ..... D3/302
6,332,815 B1 12/2001 Bruce
6,341,691 B1 * 1/2002 Voss ..... 206/397
6,352,215 B1 * 3/2002 Cash ..... B21C 47/30 242/574.2
6,375,116 B1 * 4/2002 Askins ..... B65H 75/185 242/599.2
6,386,912 B1 5/2002 Li
6,390,840 B1 5/2002 Wang
D458,904 S 6/2002 Montena
6,402,085 B1 * 6/2002 Smith ..... 242/578
6,402,155 B2 6/2002 Sakata
6,406,330 B2 6/2002 Bruce
D460,739 S 7/2002 Fox
D461,166 S 8/2002 Montena
D461,167 S 8/2002 Montena
D461,778 S 8/2002 Fox
D462,058 S 8/2002 Montena
D462,060 S 8/2002 Fox
6,435,447 B1 * 8/2002 Coats et al. ..... 242/483
D462,327 S 9/2002 Montena
6,478,599 B1 11/2002 Lee
6,478,618 B2 11/2002 Wong
6,488,317 B1 12/2002 Daoud
6,491,163 B1 * 12/2002 Grcic ..... B65D 85/676 206/403
D468,696 S 1/2003 Montena
6,523,777 B2 * 2/2003 Gaudio ..... 242/595.1
6,530,807 B2 3/2003 Rodrigues
6,558,194 B2 5/2003 Montena
D475,975 S 6/2003 Fox
D475,976 S 6/2003 Montena
D475,977 S 6/2003 Montena
6,634,906 B1 10/2003 Yeh
6,676,443 B1 1/2004 Wang
6,716,062 B1 4/2004 Palinkas
6,733,336 B1 5/2004 Montena
6,767,247 B2 7/2004 Rodrigues
6,767,248 B1 7/2004 Hung
6,767,249 B1 7/2004 Li
6,769,926 B1 8/2004 Montena
6,776,650 B2 8/2004 Cheng
6,776,657 B1 8/2004 Hung
6,776,665 B2 8/2004 Huang
6,780,052 B2 8/2004 Montena
6,789,653 B1 9/2004 Hsu
6,793,526 B1 9/2004 Hsu
6,799,995 B2 10/2004 Hsu
6,805,584 B1 10/2004 Chen
6,817,897 B2 11/2004 Chee
6,830,479 B2 12/2004 Holliday
6,848,939 B2 2/2005 Stirling
6,848,940 B2 2/2005 Montena
6,860,751 B1 3/2005 Huang
D503,685 S 4/2005 Montena
D504,113 S 4/2005 Montena
D504,114 S 4/2005 Montena
D504,202 S 4/2005 Montena
6,881,075 B2 4/2005 Huang
6,884,113 B1 4/2005 Montena
D505,391 S 5/2005 Rodrigues
6,887,090 B2 5/2005 Lin
D506,446 S 6/2005 Montena
6,908,337 B1 6/2005 Li
6,910,919 B1 6/2005 Hung
D507,242 S 7/2005 Montena
6,923,397 B2 * 8/2005 Inana et al. ..... 242/348
6,929,501 B2 8/2005 Huang
6,929,507 B2 8/2005 Lin
6,935,874 B1 8/2005 Fang
6,935,878 B2 8/2005 Hsu
6,948,969 B2 9/2005 Huang
6,948,973 B1 9/2005 Hsu
6,951,469 B1 10/2005 Lin
6,956,464 B2 10/2005 Wang
D511,497 S 11/2005 Murphy
D511,498 S 11/2005 Holliday
D512,024 S 11/2005 Murphy
D512,689 S 12/2005 Murphy
D513,406 S 1/2006 Rodrigues
D513,736 S 1/2006 Fox
D514,071 S 1/2006 Vahey
6,991,098 B2 * 1/2006 Silverbrook et al. ..... 206/225
D515,037 S 2/2006 Fox
6,994,588 B2 2/2006 Montena
7,001,204 B1 2/2006 Lin
7,004,765 B2 2/2006 Hsu
7,004,777 B2 2/2006 Hsu
7,008,263 B2 3/2006 Holland
7,018,235 B1 3/2006 Burris
D518,772 S 4/2006 Fox
D519,076 S 4/2006 Fox
D519,451 S 4/2006 Fox
D519,452 S 4/2006 Rodrigues
D519,453 S 4/2006 Rodrigues
D519,463 S 4/2006 Tamezane
7,021,965 B1 4/2006 Montena
D521,454 S 5/2006 Murphy
D521,930 S 5/2006 Fox
7,063,551 B1 6/2006 Lin
7,114,990 B2 10/2006 Bence
7,118,416 B2 10/2006 Montena et al.
7,128,603 B2 10/2006 Burris
7,147,178 B2 * 12/2006 Kan ..... 242/588
D535,259 S 1/2007 Rodrigues
7,182,639 B2 2/2007 Burris

(56) References Cited

U.S. PATENT DOCUMENTS 7,188,416 B1 3/2007 Woehlke et al.
7,192,308 B2 3/2007 Rodrigues
7,204,452 B2 * 4/2007 Wilkinson et al. ..... 242/614
D543,948 S 6/2007 Montena
D544,837 S 6/2007 Disbennett
7,241,172 B2 7/2007 Rodrigues
7,252,546 B1 8/2007 Holland
7,255,598 B2 8/2007 Montena
7,288,002 B2 10/2007 Rodrigues
7,303,436 B1 12/2007 Rodrigues
7,354,462 B2 4/2008 Holland
7,364,462 B2 4/2008 Holland
7,371,113 B2 5/2008 Burris
7,479,035 B2 1/2009 Bence
7,500,635 B2 * 3/2009 Cooper et al. ..... 242/588.6
7,507,117 B2 3/2009 Amidon
7,513,795 B1 4/2009 Shaw
7,527,219 B2 * 5/2009 Klick ..... 242/613
7,533,782 B2 * 5/2009 Parker et al. ..... 220/326
D601,966 S 10/2009 Shaw
D601,967 S 10/2009 Shaw
D607,826 S 1/2010 Shaw
D607,827 S 1/2010 Shaw
D607,828 S 1/2010 Shaw
D607,829 S 1/2010 Shaw
D607,830 S 1/2010 Shaw
D608,294 S 1/2010 Shaw
7,753,705 B2 7/2010 Montena
7,824,216 B2 11/2010 Purdy
7,841,896 B2 11/2010 Shaw
7,845,976 B2 12/2010 Matthews
7,892,005 B2 2/2011 Haube
7,892,024 B1 2/2011 Chen
7,931,509 B2 4/2011 Shaw
7,938,357 B2 * 5/2011 Johanson et al. ..... 242/588.6
7,955,126 B2 6/2011 Bence
D663,698 S * 7/2012 Allwood ..... D13/155
8,286,906 B2 * 10/2012 Ripplinger ..... 242/614.1
8,366,126 B2 * 2/2013 Galgano et al. ..... 280/47.19
8,371,519 B2 * 2/2013 McManus et al. ..... 242/588.6
8,579,224 B2 * 11/2013 Allwood ..... B65H 49/32 242/423
8,708,144 B2 * 4/2014 Babcock et al. ..... 206/395
8,820,717 B2 * 9/2014 Shrader ..... B60P 7/0876 254/281
8,955,786 B2 * 2/2015 Motoji ..... A62C 33/04 137/355.26
2001/0006202 A1 * 7/2001 Inana et al. ..... 242/348
2002/0125161 A1 * 9/2002 Cote ..... B65D 5/5014 206/408
2002/0146935 A1 10/2002 Wong
2003/0092319 A1 5/2003 Hung
2003/0194902 A1 10/2003 Huang
2003/0234317 A1 * 12/2003 Burkitt ..... 242/594.5
2003/0236027 A1 12/2003 Wang
2004/0053533 A1 3/2004 Huang
2004/0067688 A1 4/2004 Cheng
2004/0077215 A1 4/2004 Palinkas
2004/0102095 A1 5/2004 Huang
2004/0147164 A1 7/2004 Li
2004/0171297 A1 9/2004 Hsu
2004/0171315 A1 9/2004 Liao
2004/0224556 A1 11/2004 Qin
2005/0009379 A1 1/2005 Huang
2005/0020121 A1 1/2005 Lin
2005/0032410 A1 2/2005 Huang
2005/0035240 A1 * 2/2005 Weck ..... B65H 49/322 242/588.4
2005/0070145 A1 3/2005 Huang
2005/0075012 A1 4/2005 Hsu
2005/0153587 A1 7/2005 Hsu
2005/0159030 A1 7/2005 Hsu
2005/0186852 A1 8/2005 Hsu
2005/0186853 A1 8/2005 Hsu
2005/0202690 A1 9/2005 Lien
2005/0202699 A1 9/2005 Hsu
2005/0205713 A1 * 9/2005 Ripplinger ..... 242/608
2005/0233632 A1 10/2005 Hsu
2005/0250357 A1 11/2005 Chen
2005/0260894 A1 11/2005 Chen
2006/0094300 A1 5/2006 Hsu
2006/0110977 A1 5/2006 Matthews
2006/0121753 A1 6/2006 Chiang
2006/0121763 A1 6/2006 Chiang
2006/0231672 A1 * 10/2006 Eastwood ..... B65H 49/322 242/588.2
2006/0292926 A1 12/2006 Chee
2009/0098770 A1 4/2009 Bence
2010/0059619 A1 * 3/2010 Schillo ..... B60P 7/0876 242/388.6
2010/0078514 A1 * 4/2010 Thompson ..... 242/588
2011/0021072 A1 1/2011 Purdy
2011/0240791 A1 * 10/2011 Lindley et al. ..... 242/609
2012/0091249 A1 * 4/2012 Crossett et al. ..... 242/580
2012/0168554 A1 * 7/2012 Blunt ..... B65D 85/04 242/588.2
2012/0187232 A1 * 7/2012 Molen ..... B60P 7/0876 242/557

FOREIGN PATENT DOCUMENTS

WO WO 93/05547 3/1993
WO WO 93/24973 12/1993
WO WO 96/20516 7/1996
WO WO 96/20518 7/1996
WO WO 97/22162 6/1997
WO WO/1999/065117 12/1999
WO WO/1999/065118 12/1999
WO WO/2003/096484 11/2003
WO WO/2005/083845 9/2005

* cited by examiner

CABLE REEL AND REEL CARRYING CADDY

CROSS REFERENCE TO RELATED APPLICATION

This utility patent application is based upon. and claims priority from, previously filed U.S. Provisional Patent application entitled "Cable Reel, Dispensing and Carrying Caddy For Reels, and Packaging Thereof," Ser. No. 61/627,261, Filed Oct. 7, 2011, by inventors Robert J. Chastain, Denton McDonald, James S. Carter, David Allen Kelly, Chrispin A. Bowen, and Glen David Shaw.

BACKGROUND OF THE INVENTION

I. Field of the Invention

The present invention relates generally to reels or spools containing wire or cable. More particularly, the present invention relates to cable reels and reel housings or carriers that facilitate the shipment, transportation, dispensing, and installation of elongated wires and cables, particularly coaxial cable. Known prior art related to the reel carrier component of the invention is classified in United States Patent Class 242, Subclasses 588, 588.1, 588.2 and 588.3 and in Class 206 Subclass 389.

II. Description of the Prior Art

Reels are well known in the art for storing and dispensing a wide variety of wires, cables and coaxial cables. Coaxial cable is widely used in the satellite and cable television business for distributing wide-band signals to television apparatus and related accessories. Various other cables, including multi-conductor cables and fiber-optic cables, are widely used for Internet-related applications, and digital data transmission and distribution in conjunction with diverse computer networks, including local-area and wide-area networked systems. Wired computer networks are the backbone of the Internet.

Reels for storing wires and cables typically include a hollow, tubular core extending between spaced apart ends or flanges. In general, wire wound around the core is held in place by the flanges. Reels containing flexible media that are intended for industrial transport and storage vary greatly in size. Reels have traditionally been fabricated out of wood or metallic materials, and have more recently been fabricated from paper and plastic.

In the prior art, it is known to house coils of cable in boxes, and to manually pull selected lengths of cable out of the box. Wires and cables are conventionally wound around reels or "spools" that may be packaged in various forms of containers. A wide variety of prior art configurations exist. Traditional packaging methods such as cardboard, wood or metal are inefficient and non-standardized, and are bulky and heavy due to the typical packaging materials required for transportation and use. Boxes of cable are heavy and difficult to move around. Boxed reels also require the additional steps of removing tape or straps sealing the box before the cable can be removed. These problems are amplified by the fact that modern, large scale construction projects require large lengths of numerous cables of different types, thicknesses and characteristics. In large complex jobs, numerous boxes of various cables quite often end up haphazardly placed around the work site in a disorganized manner. Empty reels and packaging typically cannot be reused and have to be disposed of as waste.

It is known in the art to rotatably support wire reels within a portable enclosure that functions as a housing and carrying case. Such rotating reel assemblies include a reel that is rotatably connected to a frame within a box or generally parallelepiped enclosure. The rotating reel assembly permits the user to simply pull out the cable. Some designs include an axle that penetrates the spool and is rotatably coupled between suitable end points in the supporting frame that enable rotation. However, these arrangements often do not feed as well when the cable is pulled at an angle and they require that the axle be detached from the frame and withdrawn from the reel to remove and replace an empty spool. Typically, ends of the supportive spool axle are fitted within inexpensive frame cradles that enable rotation and function as inexpensive bearings. Such designs make it easier to remove the spools but, over time, the reliability and durability of the support cradle are compromised.

For example, as cable is drawn from conventionally designed spools, the spool tends to wear out the support cradles or bearings due to the weight of the cable and the minimal surface area contact between the spool and bearings. This can cause the spool to wobble or bind restricting wire or cable from being unwound. As wire or cable is removed from the spool there may not be sufficient friction to allow the spool to stop spinning, resulting in the spool "freewheeling" allowing wire or cable to unwind faster than it can be conveniently pulled away by the technician. This can result in cable tangles or spool misalignment. The installing technician must then waste potentially valuable time untangling cables and adjusting the spool or reel.

In the prior art, U.S. Pat. No. 8,016,222 issued Sep. 13, 2011 discloses a wire or cable dispensing cart with several reels of cable in cartons. Cable is pulled through a slot in the carton's front panel. Preferably, left and right panels of the carton each have an arbor hole formed therein which receives an axial rod, the rod also extending through the reel and caddies. In one embodiment, cable may be pulled through one or more pass-through slots formed in the tops and bottoms of stacked containers, such that cable from multiple containers is drawn through one slot on the top of the stack.

U.S. Pat. No. 6,523,777 issued Feb. 25, 2003 shows a portable wire spool caddy that releasably holds a cylindrical spool while cable is unwound from the spool. An elongated frame includes first and second spaced apart ends, a plurality of parallel rods which each extend between and are connected to the first and second ends, and at least one movable rod which is generally parallel to the fixed rods which extends between the ends. The spool is retained between the movable rod and the fixed rods, and when the movable rod is in its second position the spool may be removed or inserted between the movable rod and the adjacent fixed rod.

U.S. Pat. No. 6,234,421 issued May 22, 2001 discloses a reel for supporting wound cables. The reel has a core, first and second flanges, and at least one locking ring. The core has first and second ends, an inner surface and an outer surface. The first flange, which attaches to the first end of the core, includes a first plurality of flexible fingers that extend axially inward the core adjacent to said inner surface proximate the first end. The second flange attaches to the second end of the core and includes a second plurality of flexible fingers that extend axially inwardly proximate the second end. The locking ring urges the first plurality of flexible fingers to the inner surface proximate the first end.

U.S. Pat. No. 5,775,621 issued Jul. 7, 1998 discloses a combination reel caddy and stand for cable spools of the type having a central drum and enlarged disk-like ends with central openings therein. The stand comprises a generally U-shaped handle portion having a curved end and elongated leg portions with the leg portions carrying stub spindle members adapted to be received in the spool disk. The spool can be rotated and lifted about the legs and then with the handle portion on the same surface as the ends of the stand legs the spool can be freely rotated for unwinding or winding cable therefrom.

Thus, a suitable reel caddy should be designed with considerations for transportation and storage of the reel caddy both with the reel loaded into the caddy and separately. The design should allow for minimal consumption of volume on pallets and in bulk shipping containers. Caddies and reels that can be efficiently stacked will reduce transportation and storage costs. A design that incorporates shipping into the reel and caddy can also reduce waste in unnecessary packing materials to stabilize and protect the reel and caddy in transit.

For instance if the reels have a shape and features that allow them to be stacked end-to-end vertically, and minimize wasted space when the stacks are combined on a pallet or in a shipping container, volume required for transportation and storage can be reduced. If the caddies can be stacked efficiently like the reels then a further reduction in transportation and storage costs results. An added benefit of a reel caddy designed and built in the manner is that shipping and storage damages is also minimized due to the stable configuration of the reel caddy during shipping.

In addition to the shape, if the reel caddy is designed and fabricated using durable, lightweight materials, more product can be transported more easily at lower cost, with less damage to the product. Cardboard boxes may be lightweight, but are not as durable as plastic and are susceptible to weather conditions. Wood or metal containers are strong and weather resistant but typically take up more space and weight more than plastic containers. Lightweight, durable plastic is an ideal material for a reel caddy for shipping, storage and day-to-day use.

A primary feature of a reel caddy is that it be perform the task of dispensing cable, wire or fiber at a work site and allow the installer or other user to perform their job efficiently and effectively. An installer typically carries all tools and cable in a vehicle. A reel caddy that can easily be stored and efficiently stacked in a vehicle is important. Installers may require multiple types of cable, wire or fiber, and may also carry multiple spare reels as well. So not only must the reel caddy itself be easily stored in a vehicle, the reels must also meet the same criteria.

Once an installer reaches a jobsite, all of the installer's tools and need to be moved to the location where work is being performed. The reel caddy must easily stack and remain stable on a dolly, handcart, or other carrying device two-wheel. Weight must also be minimized to help in transportation of the reel caddy. A reel caddy with matching interlocking tops and bottoms allows stacking of multiple caddies vertically in a stable column. A comfortable carrying handle is also a requirement to enable an installer to carry a reel caddy in each hand. Additional hand holds are desirable to allow the caddy to be lifted regardless of its orientation. Reels in cardboard boxes tend to tear and are harder to grip. The capability for the installer to easily open the caddy when needed, preferably with one hand, to install a reel or switch reels is desirable.

The reel caddy must provide a smooth flow of cable, wire or fiber from the caddy. The shape and position of the outlet is important in providing this feature. If the cable snags on the outlet, then the caddy or container could be dragged across the work site. The cable must feed freely regardless of the angle of pull from the mouth of the caddy. The reel caddy must also provide sufficient friction to stop the feed of cable from the caddy once the installer stops pulling. A reel that keeps spinning, or "freewheels," in the caddy results in tangled cable that may require significant time to untangle so that the installer's work can continue. A reel caddy that includes a variable braking capability between the reel and bearing surfaces meets these criteria by providing greater braking friction when the reel is full, and reducing braking friction as the reel is emptied.

A reel caddy should also be stable and contain the reel in various positions, even upside down. A reel caddy that provides a secure latching mechanism and is designed to stabilize the reel and even feed cable or wire regardless of the orientation is desirable.

Installers may simultaneously install multiple types of cable and wire, pulling all cable and wire at the same time, so a reel caddy that can contain different types of cable and wire and can be stacked with interlocking feet on the bottom and indentions in the top makes this a simple task for the installer. To minimize reel replacement, a desirable reel caddy should be able to effectively contain as much cable as can be carried or transported around the work site easily, for instance one-thousand feet of RG-6 coaxial cable. It is important to be able to determine how much cable is left on a reel so that there is sufficient cable for a particular job, or so that an installer can insure that spare reels are available. A reel caddy that can be opened to allow full observation of the cable on the reel is essential. While visual inspection is important, electronic tools exist that can measure both the length and quality of cable on a reel. In order to use such an electronic tool, an installer must have access to both ends of the cable on the reel, making this access a critical feature of a reel caddy. Not to be overlooked is the ability to visually determine the type of cable on a reel. Even though the cable may be marked, access to the entire reel can usually make identification of the cable type easier than having to pull out sufficient cable to find the markings.

A work site is full of challenges for a reel caddy in that the caddy may be located on gravel, concrete, dirt or even in mud. The caddy may also be exposed to the elements such as rain, snow or direct sunlight and high heat or extreme cold. Undoubtedly a reel caddy on a work site will be banged, dropped, slid across the ground, and generally abused. It is critical for a suitable reel caddy to be durable enough to take the abuse, protect the cable, and continue to function effectively. The reel caddy must also protect the cable from the elements and maintain its integrity.

Features that help reduce the risk of theft are virtually non-existent in current cable deployment systems. An effective reel caddy should include features that help reduce theft but do not hinder use of the caddy. For example a reel including unique spindle keys that are matched between reel and caddy or unique to a particular user, reels with no through hole to prevent insertion of a common rod or pole as an axle, and color coded reels and caddies, are all desirable features.

An environmentally friendly reel caddy is desirable, ideally a solution that can satisfy multiple uses and can be reused, and that does not generate waste by requiring any significant packing materials for transportation or use. A suitable reel caddy should work with a wide variety of cable, wire and fiber types. The reel should have the capability to be respooled by the owner or by returning to the distributor. A reel caddy made of lightweight durable materials can reduce consumption of fuels in transportation. A reel caddy where the reel and caddy have been designed for efficient stacking to maximize stability, minimize damage, and minimize additional packaging material can reduce waste packaging material and reduce storage space requirements in transportation, storage, and on a work site.

SUMMARY OF THE INVENTION

A resilient plastic, two piece caddy comprising a portable housing for storing reels of cable or wire. A lower base forms an enclosure in which a reel can be rotatably mounted. A pivoted top hinged to the base can enclose the caddy. A handle enables the box-like enclosure to be conveniently carried.

Each reel comprises a spool of cable or wire. The spool has a central axle coupled at each end to spaced apart, flange-like end caps that restrain wound wire. The end caps have inner portions coupled to the axle, and outer, bearing races coaxial with the axle to which molded plastic spindles are coupled to enable rotation. Each spindle comprises a projecting bearing portion rotatably engaging the bearing race defined in each end cap, and an outwardly projecting hub adapted to be placed within suitable gudgeons internally defined within opposite caddy ends to rotatably mount the reel.

A preferably single-piece spindle is permanently mounted to and captivated by one reel end cap. An opposite, multi-piece spindle comprises a captivated bearing portion that is likewise engaged with a bearing race within the adjacent end cap, and a separate removable hub. The separate removable hub is axially coupled to a socket defined within its companion bearing structure. When reels are mounted in the caddy for use, the single-piece spindle hub and the removable spindle hub are axially aligned, and both seat within gudgeons in opposite caddy ends to establish reel rotation. The removable hub forms a security key that can be designed to fit only selected reels with matching sockets. Alternatively, the removable hub can be keyed to specific gudgeons.

The removable hub contributes a functional advantage to reel stacking or transportation. When bulk reels are shipped, or when two or more similar reels are transported about a work site, reels may be stacked vertically atop one another with the separate spindle hub removed. In this case, the opposite spindle hub will engage the now-exposed socket of an upper reel stacked upon it. The stacked and partially interlocking hubs promote stability during transportation.

Thus, a broad object of this invention is to provide an improved reel and carrying caddy for handling the reel for transporting and dispensing wires, coaxial cable, and the like.

Another object is to provide a caddy for efficiently and reliably carrying spools or reels of cable or wires.

A related object is to provide a carrying caddy that allows efficient and reliable replacement of depleted reels.

A basic object is to provide a cable dispensing caddy that eases the job of cable installers and promotes work site efficiency.

A related object is to provide a cable or wire dispenser that avoids cable entanglements while allowing smooth deployment of cable, wire, fiber and the like.

Another related object is to provide a caddy of the character described that enables an observer to quickly visually identify the amount of unused cable that remains on a reel.

Yet another object is to reduce shipping costs per standard measure by optimizing the caddy and reel designs for efficient stacking and placement on pallets and in containers.

A related object is to provide a cable spool design that enables reels to be quickly and stably stacked in vertical columns within pallets for efficient shipment.

Another related object is to make the transportation of cable spools easier and more convenient. It is a feature of our invention that reels can be vertically stacked in stable columns, with the spindle of a reel below engaging an exposed socket of an spindle above.

Yet another object of the present invention is to provide a rotating cable caddy of the character described that reliably journals the reel, while facilitating easy reel replacements thereby eliminating time consuming adjustments or the need for special tools.

It is also an object to provide security features to a cable caddy. It is a feature of our invention that specific reels can be provided with a matching spindle hub or "key" that must be inserted within that reel to fit within a matching caddy. Thus a specific brand and type of cable on an appropriate "approved" reel can be matched for use with a previously vended or provided caddy that is specific to a given manufacturer or cable supplier.

A related object is to provide a carrying case or caddy for rotationally mounting cable reels that can be efficiently shipped. It is a feature of our caddy that multiple units can be stacked together vertically in stable, columns where individual cadies are nested together.

Providing a "green" system is also a basic object. It is a feature of our arrangement that the caddies and reels are reusable and recyclable. Because of pallet optimization, less space is required for shipping. Finally, the designs described herein substantially obviate the need for cardboard or paper boxes or containers that form waste that must be disposed of using energy resources and landfill space.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
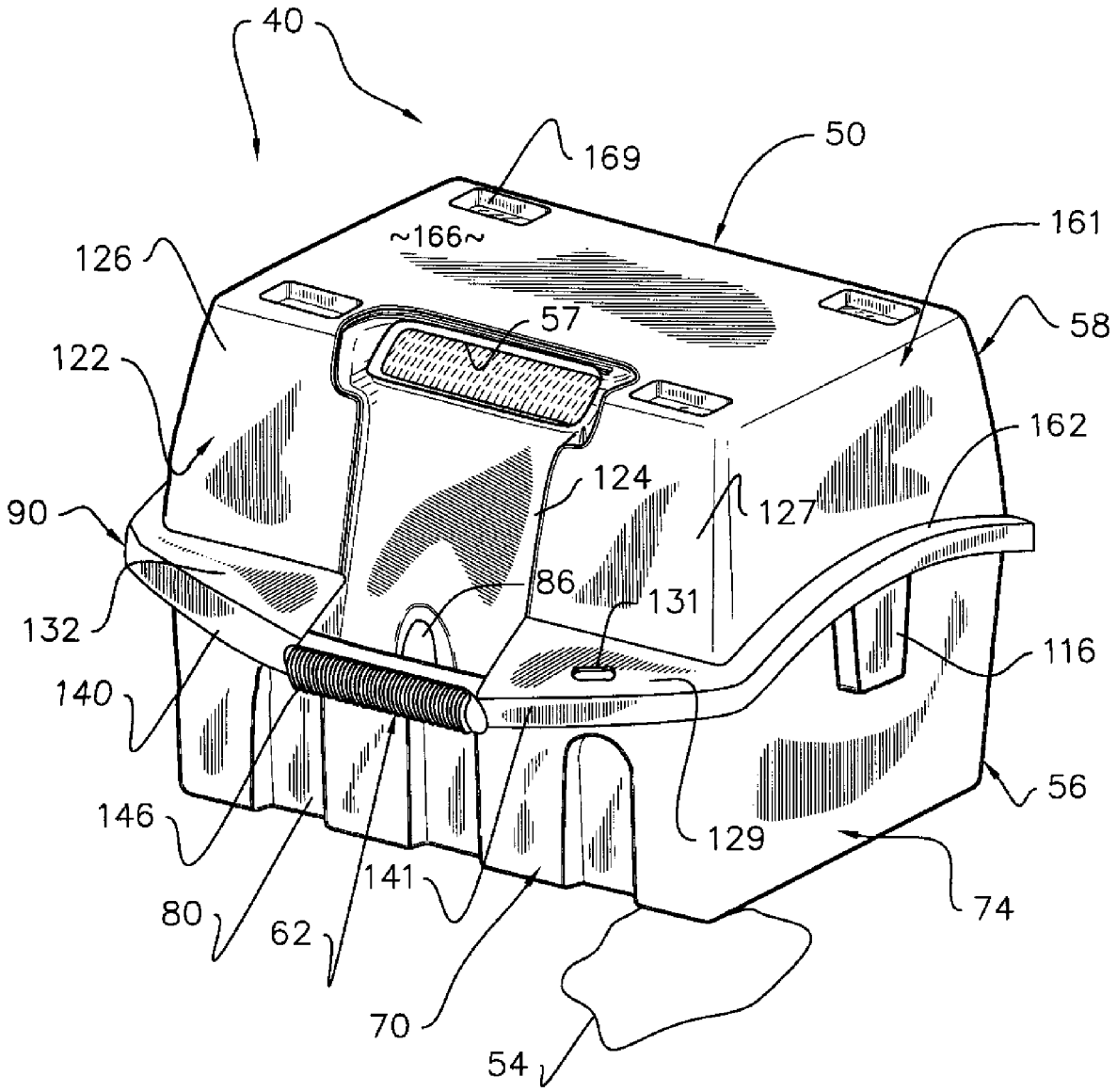
FIG. 1 is a frontal isometric view of an embodiment of our cable reel caddy, with the caddy closed.
Figure 2:
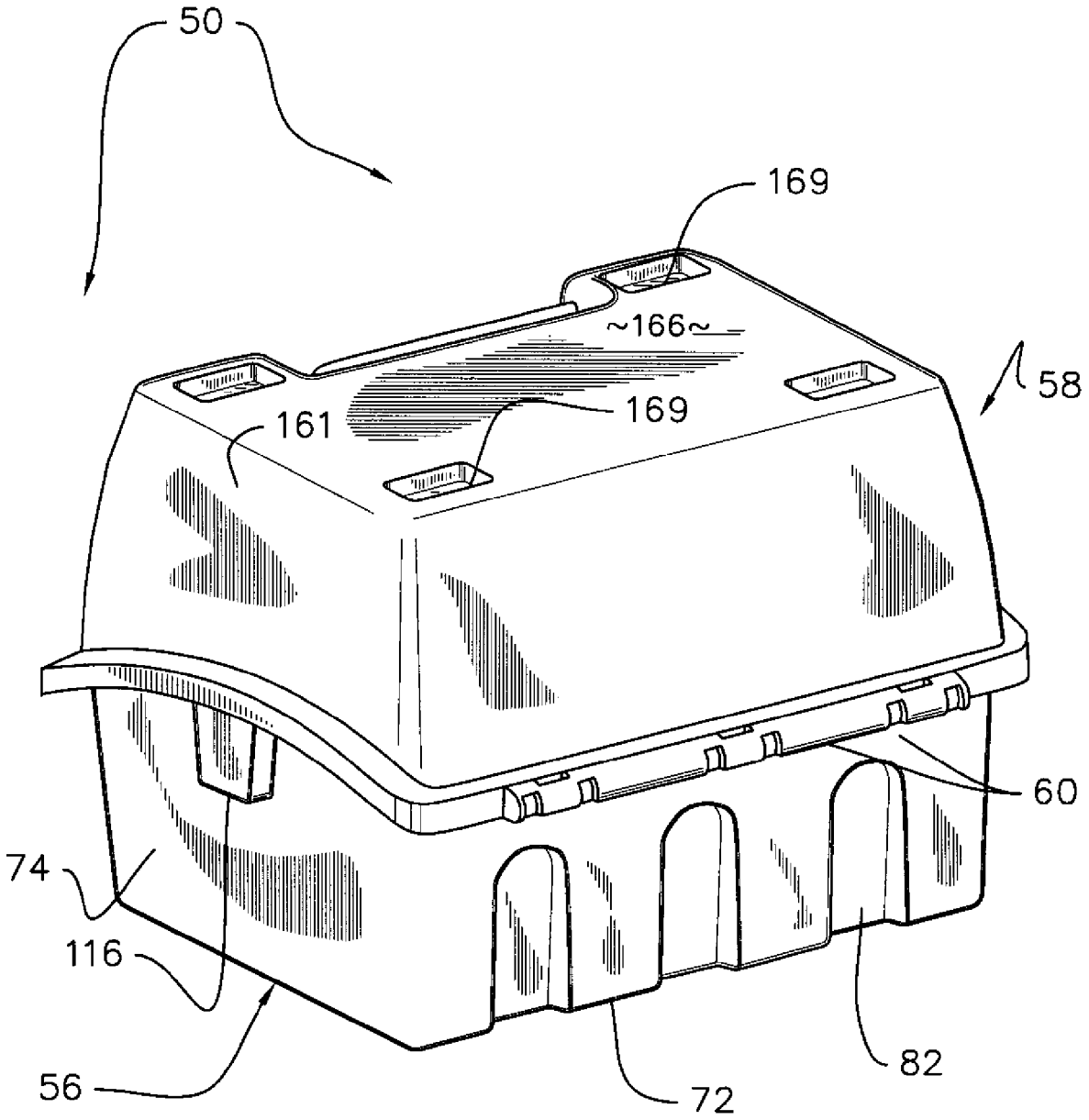
FIG. 2 is a rear isometric view of the closed cable caddy.

Referring initially to FIGS. 1-12 of the appended drawings, a system for housing and carrying reels of coaxial cable or wire, and for dispensing cable or wire, has been generally designated by the reference numeral 40. The system 40 comprises a protective, portable caddy 50 for housing a reel 52 (FIGS. 9, 10) containing wound coaxial cable (or other filamentary wire or cable) that may be rotatably disposed. Ideally, the caddy 50 is disposed upon a suitable available supporting surface 54 proximate to a work site where various types and lengths of cable are to be installed. Bottom caddy feet 59 (FIGS. 3, 4) provide support and stability. The impact resistant, plastic caddy 50 comprises a lower base 56 that forms an enclosure in which reel 52 sits, and a cooperating top 58 that is pivotally coupled to base 56 with an elongated hinge 60 (FIG. 2). Base 56 and top 58 are both generally in the form of an open parallelepiped. When caddy 50 is closed, as in FIGS. 1-5, it may be conveniently transported by grasping a front handle 62 that is formed by abutting handle portions of the base 56 and top 58 when the caddy is closed, as explained in detail hereinafter. Each of top 58 and base 56 are preferably formed of impact resistant plastic and can be created in various combinations of colors to aid in identification of the caddy 50.

Figure 7:
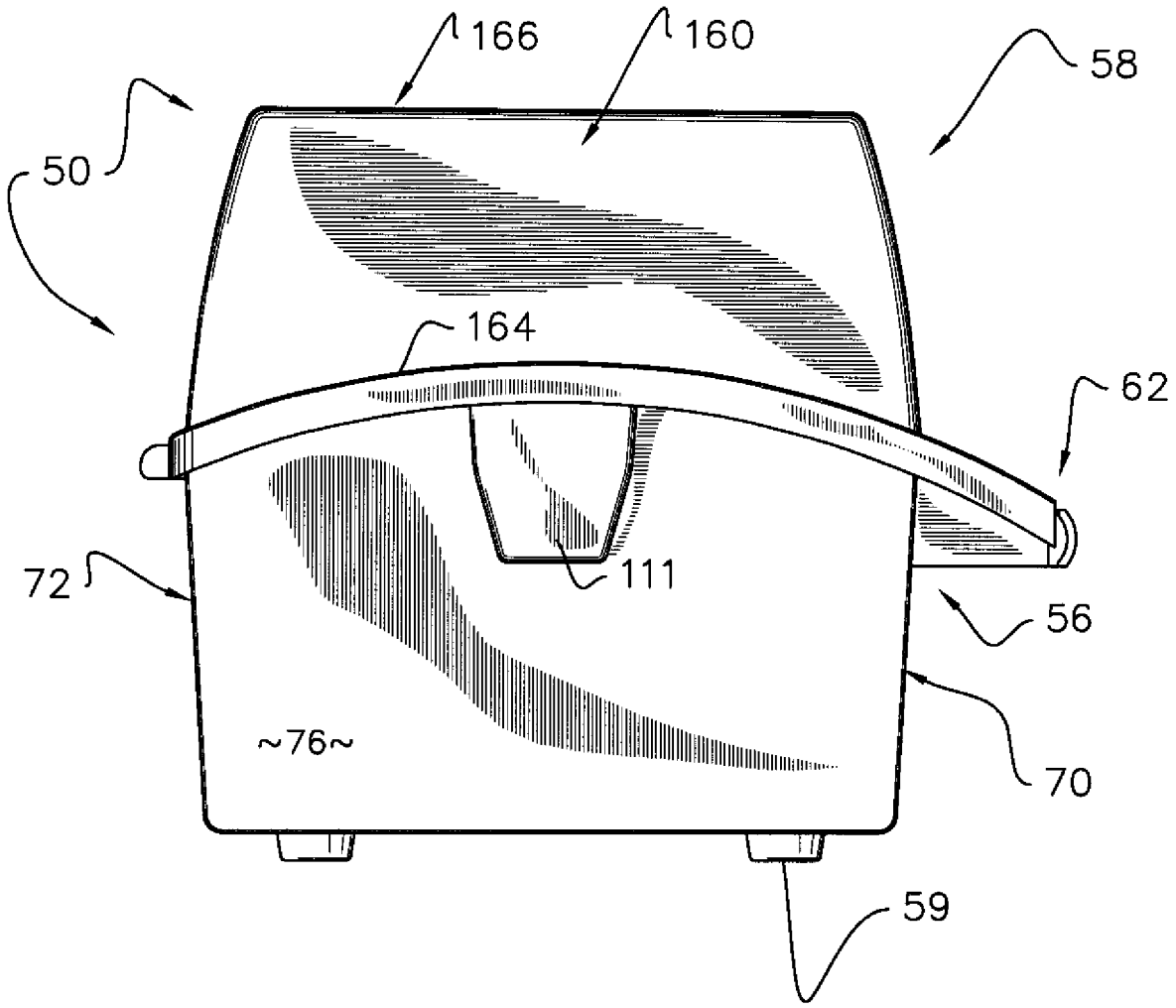
FIG. 7 is a left side elevational view of the closed caddy.
Figure 8:
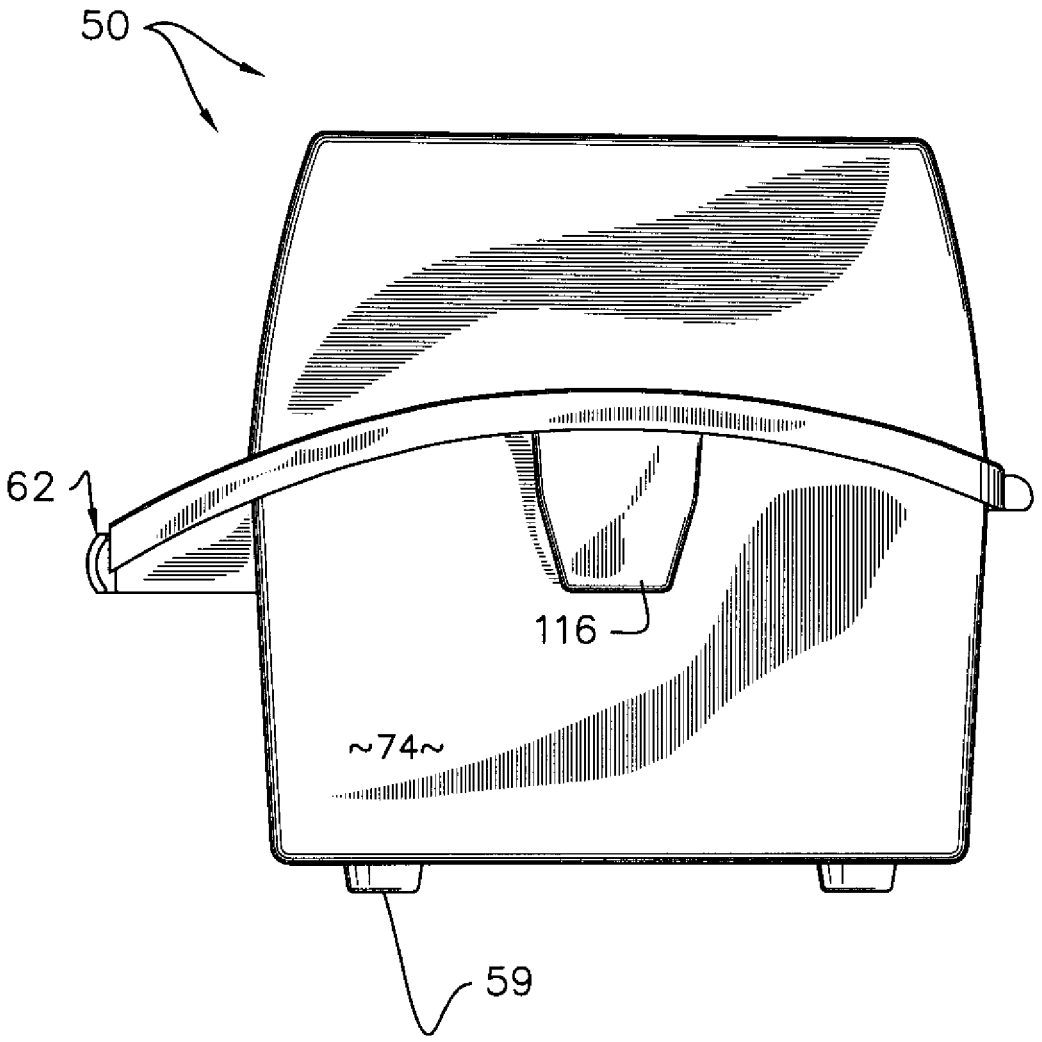
FIG. 8 is a right side elevational view of the closed caddy.
Figure 9:
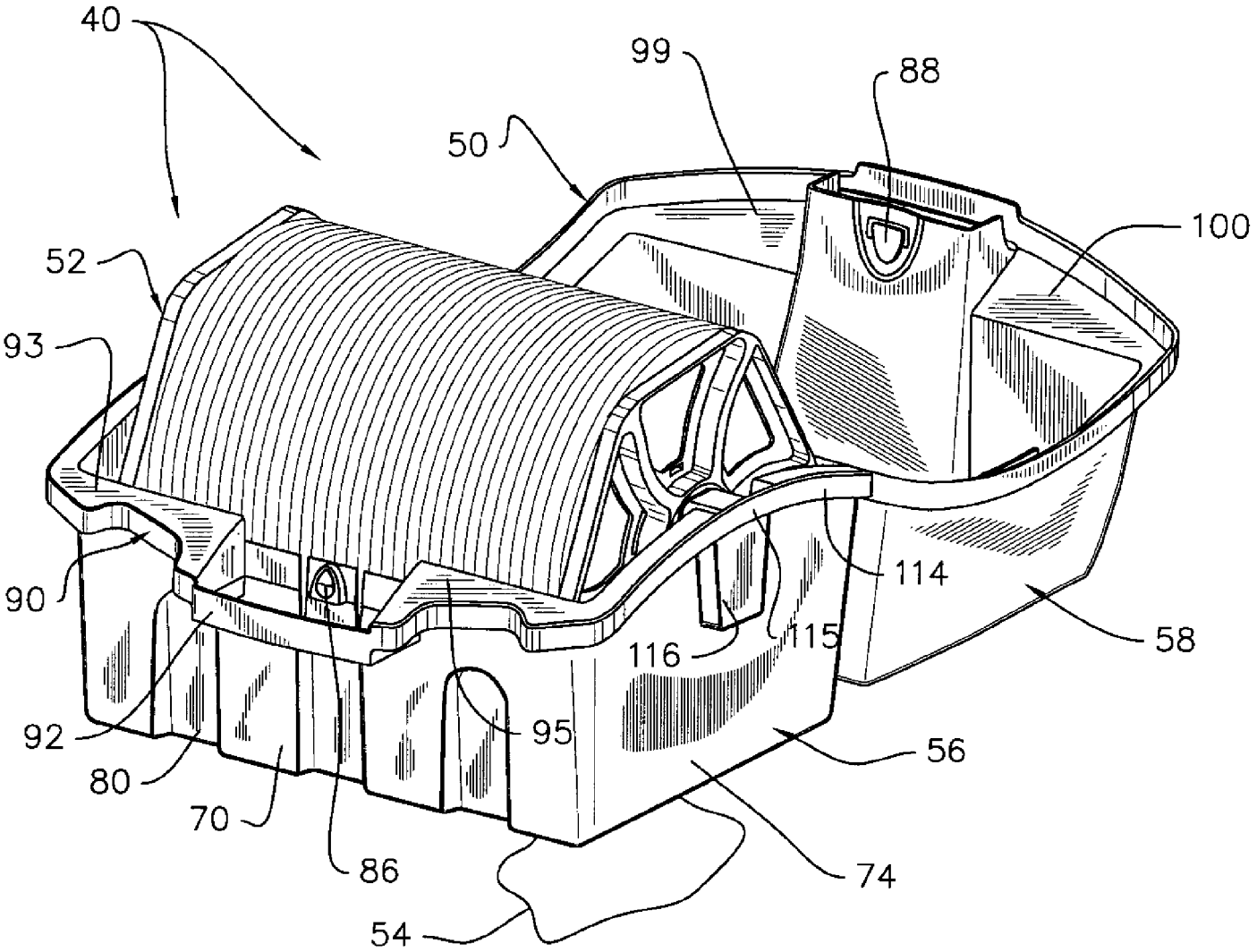
FIG. 9 is a frontal isometric view of a loaded and opened caddy.
Figure 10:
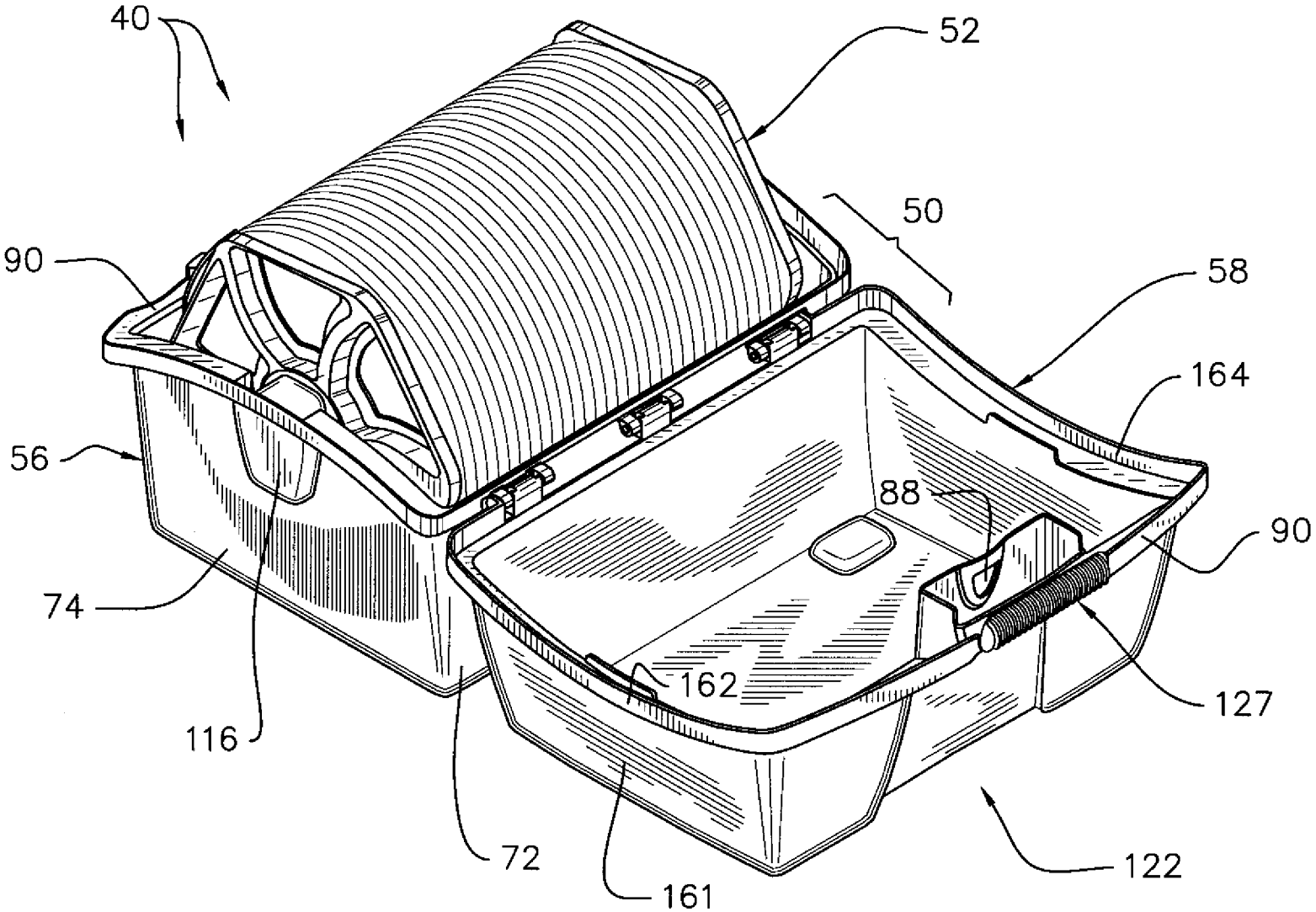
FIG. 10 is a rear isometric view of the loaded and opened caddy.
Figure 11:
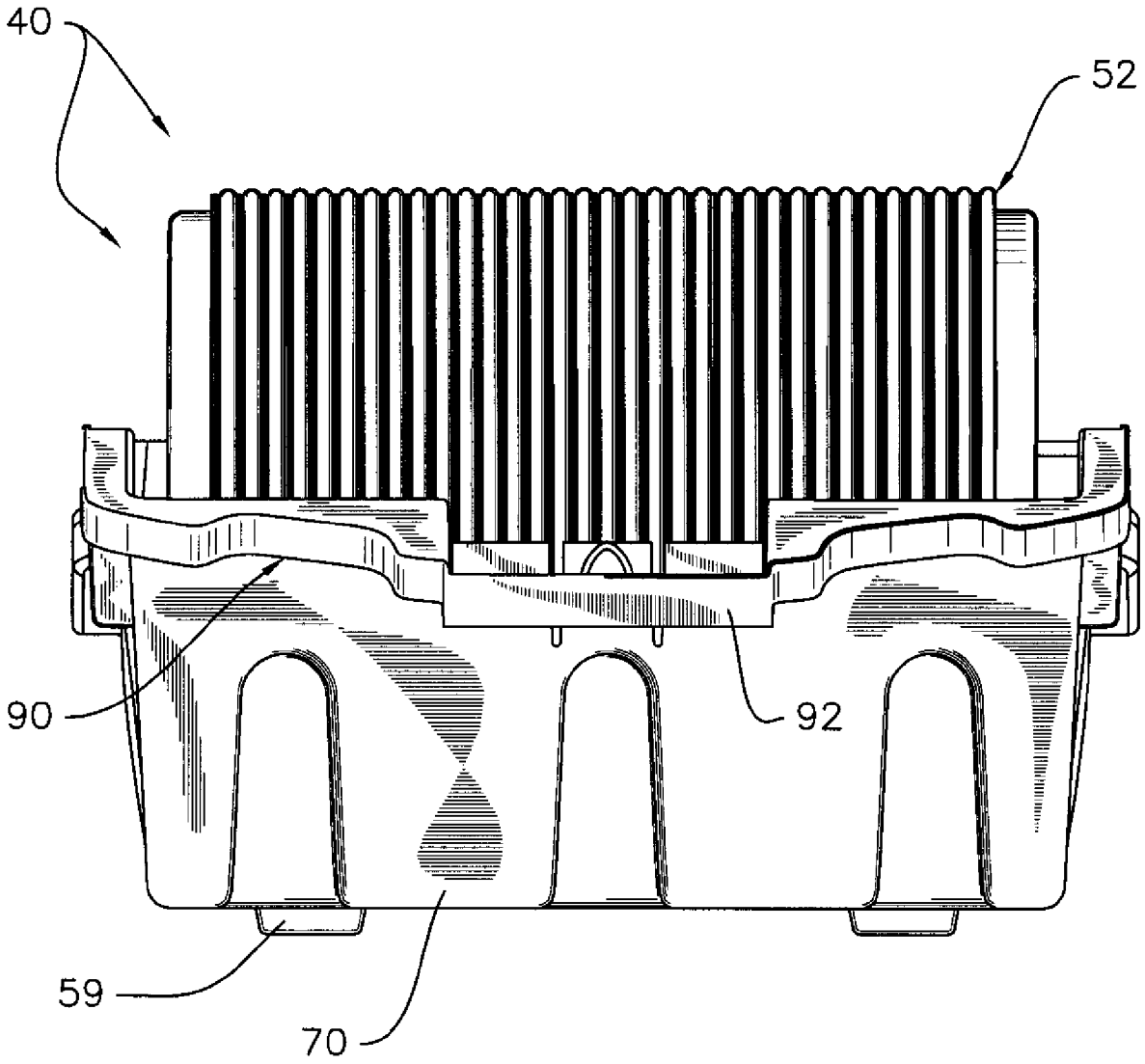
FIG. 11 is a front plan view of the loaded and opened caddy.
Figure 12:
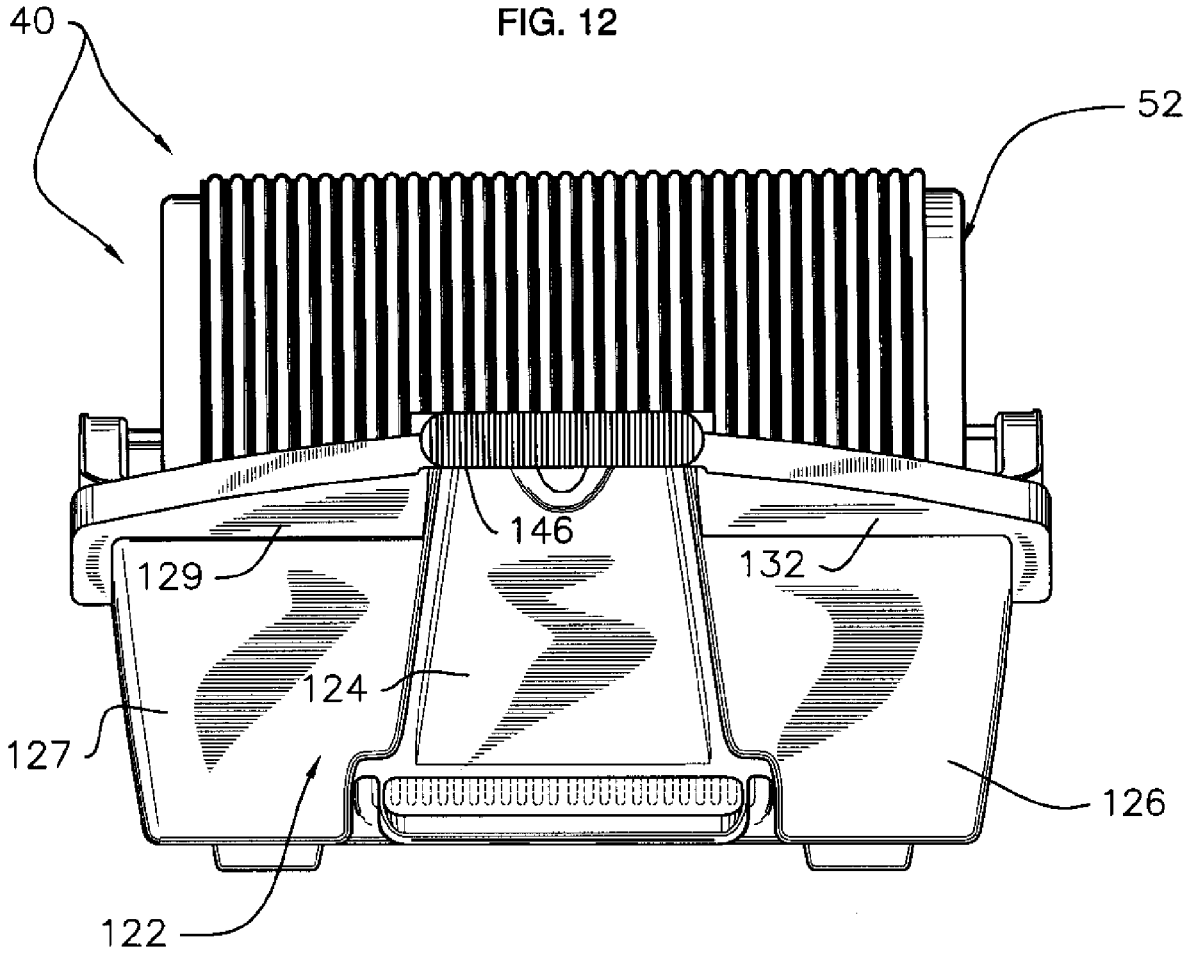
FIG. 12 is a rear plan view of the loaded and opened caddy.
Figure 13:
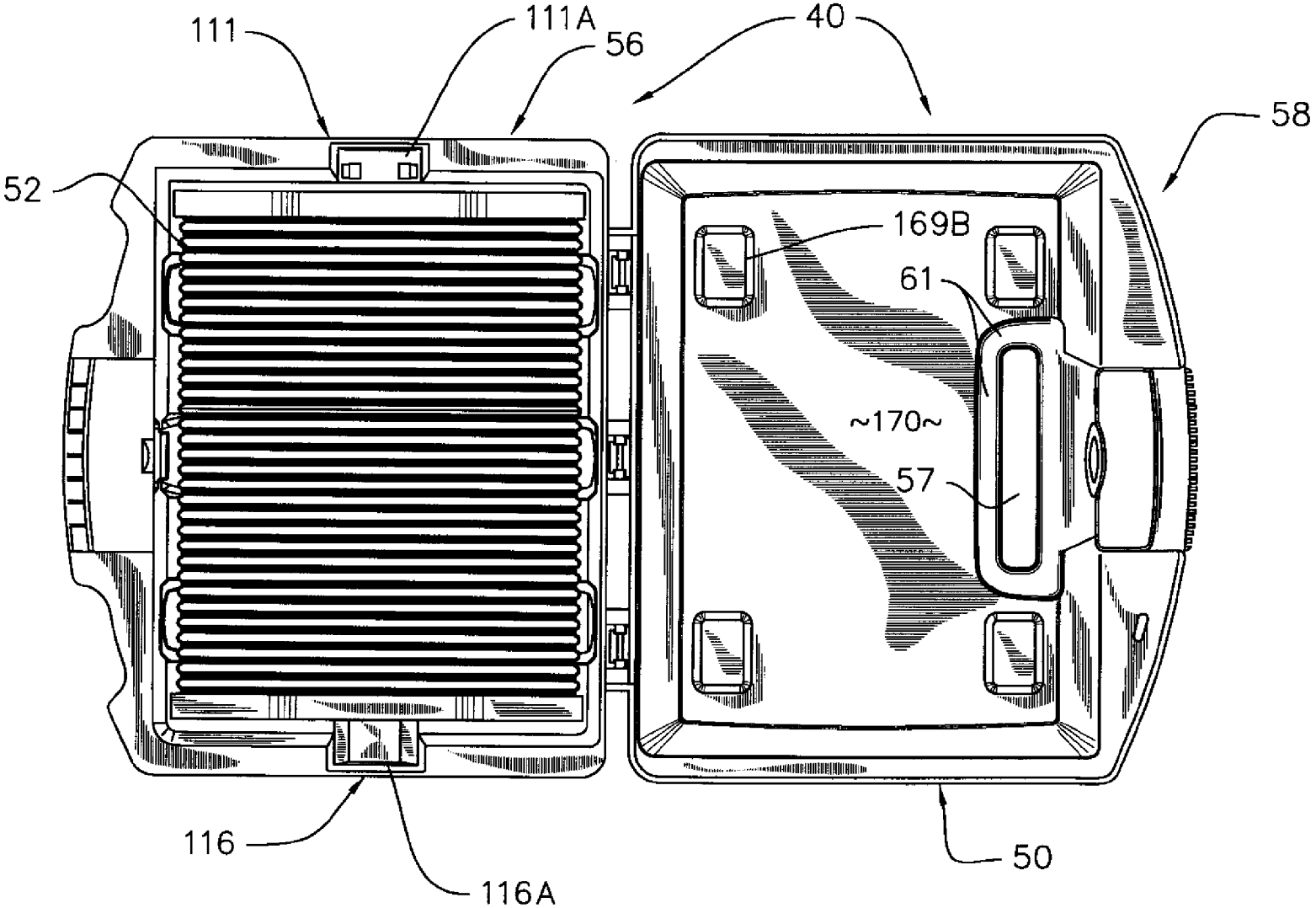
FIG. 13 is a top plan view of the loaded and opened caddy.

Base 56 forms a box-like enclosure comprising a front panel 70 and an integral rear panel 72 (FIG. 7) which are integral with right end panel 74 (FIG. 8) and left end panel 76 (FIG. 7). Front panel 70 has a plurality of spaced part, generally parabolic indentations 80 that reinforce the caddy 50 and add to aesthetic styling. Similar stylistic reinforcement indentations 82 (FIG. 4) are spaced apart on the rear caddy panel 72. At the top of the center indentation 80 on front panel 70 there is a spring-biased button 86 that releasably mates with a similarly contoured, complementary opening 88 formed in the interior of top 58 (FIG. 9, 10) to form a latch. Button 86 may be manually depressed to unengage the opening 88 and allow top 58 to rotate away from base 56 to open the caddy and expose the caddy interior. As seen in FIGS. 1, 2, and 13, top 58 has an upper, slotted front mouth 57 through which cable wound about the enclosed, interior reel 52 may be withdrawn. Mouth 57 is preferably bounded by a peripheral, generally rectangular lip 61 (FIG. 13) of generally cylindrical cross section that lessens friction or resistance as cable is withdrawn through the mouth 57. Other embodiments of mouth 57 have lip 61 covered by a smooth, low-friction grommet, or a plurality of rollers, or other mechanisms (not shown) to reduce friction on cable or wire being drawn from the caddy 50. Still other embodiments of mouth 57 have an alternative lip (not shown) that is curved slightly inwardly or outwardly to reduce friction on cable or wire being drawn from the caddy 50.

Figure 6:
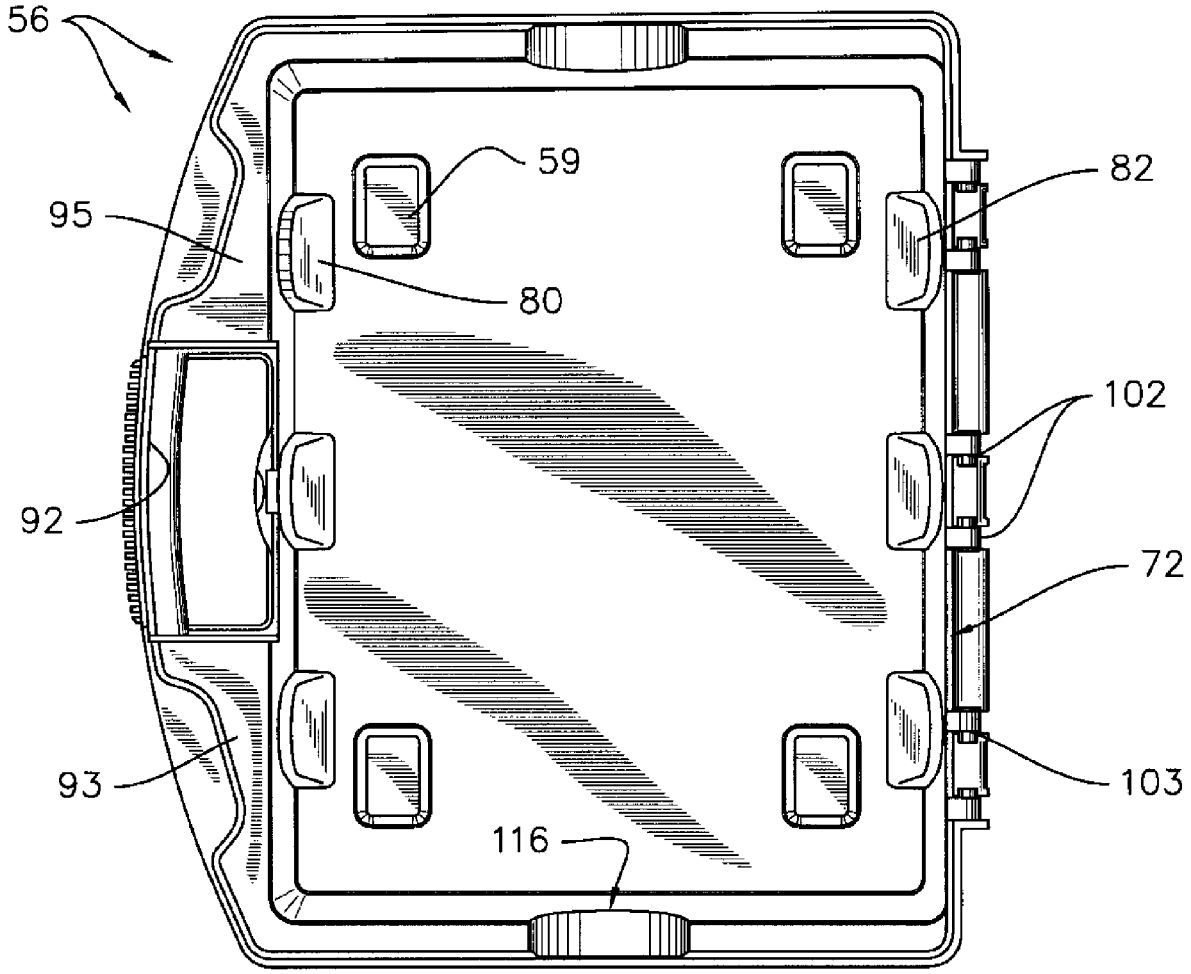
FIG. 6 is a bottom plan view of the closed caddy.

The base 56 also comprises an integral, stylized, frontal ledge 90 (FIGS. 1, 9) that reinforces the structure of the caddy to enable the base to retain its critical dimension and forms its upper periphery. The frontal ledge midportion 92 (FIGS. 9, 11) is offset from button 86 forming a lower half of the handle 62 (FIG. 1) extending integrally across the upper edges of the front panel 70. Ledge 90 comprises spaced apart, lateral triangular potions 93, 95 (FIG. 9) that nest within similarly styled recesses 99, 100 formed in the underside of top 58 (FIG. 9) when the caddy 50 is closed. The rear panel 72 hinge structure (FIG. 4) has a plurality of spaced apart pairs of upper hinge ferrules 102 integrally formed in rear peripheral ledge 104. Each pair of ferrules 102 on the base 56 is coupled to a barrel 106 from the top 58 disposed between it by a clevis pin 103 (FIG. 6). The ferrules 102 and barrels 106 are axially aligned, and form hinge 60 to allow the top 58 to pivot relative to the base 56.

Figure 14:
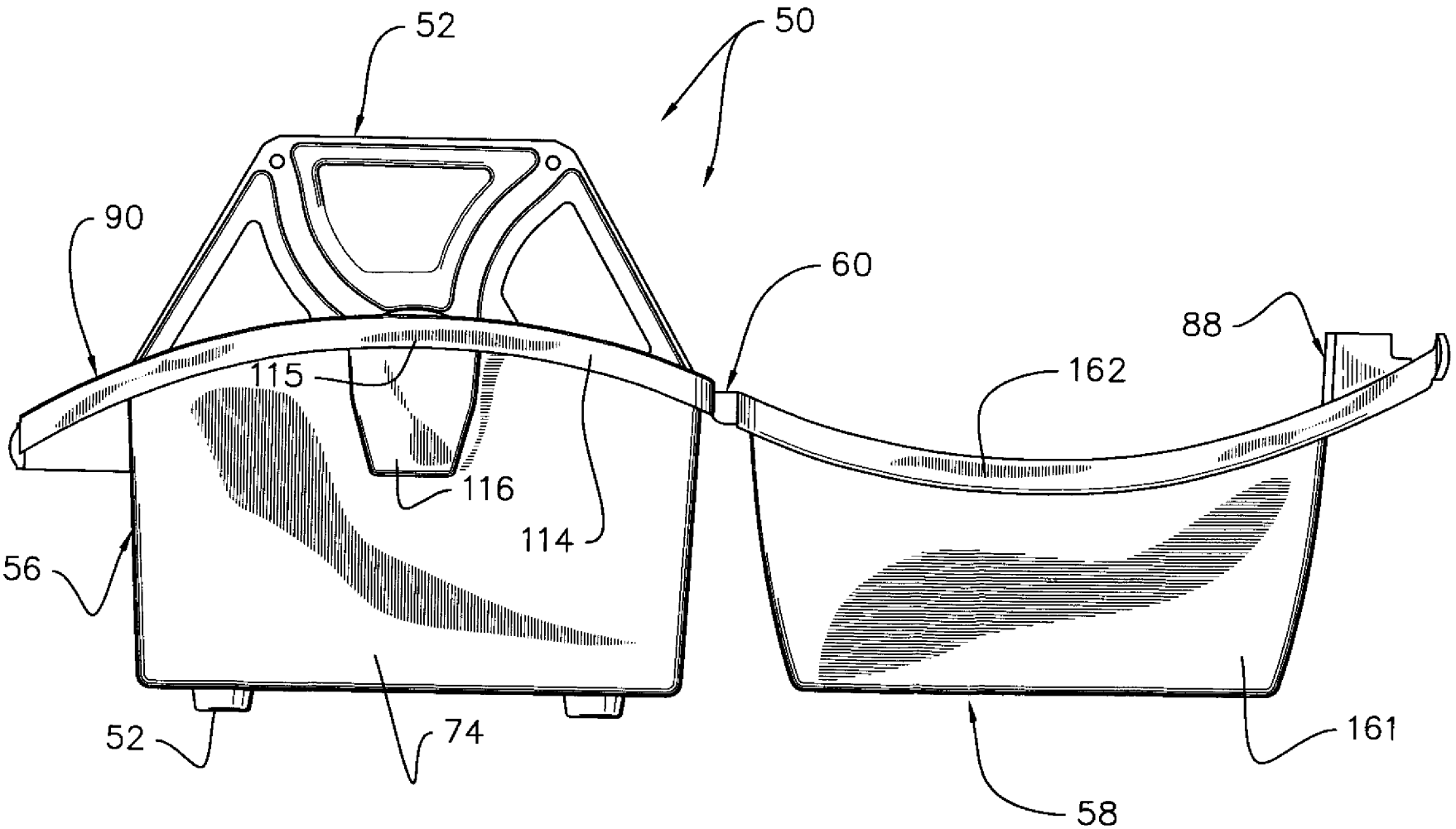
FIG. 14 is a right side elevational view of the loaded and opened caddy.
Figure 15:
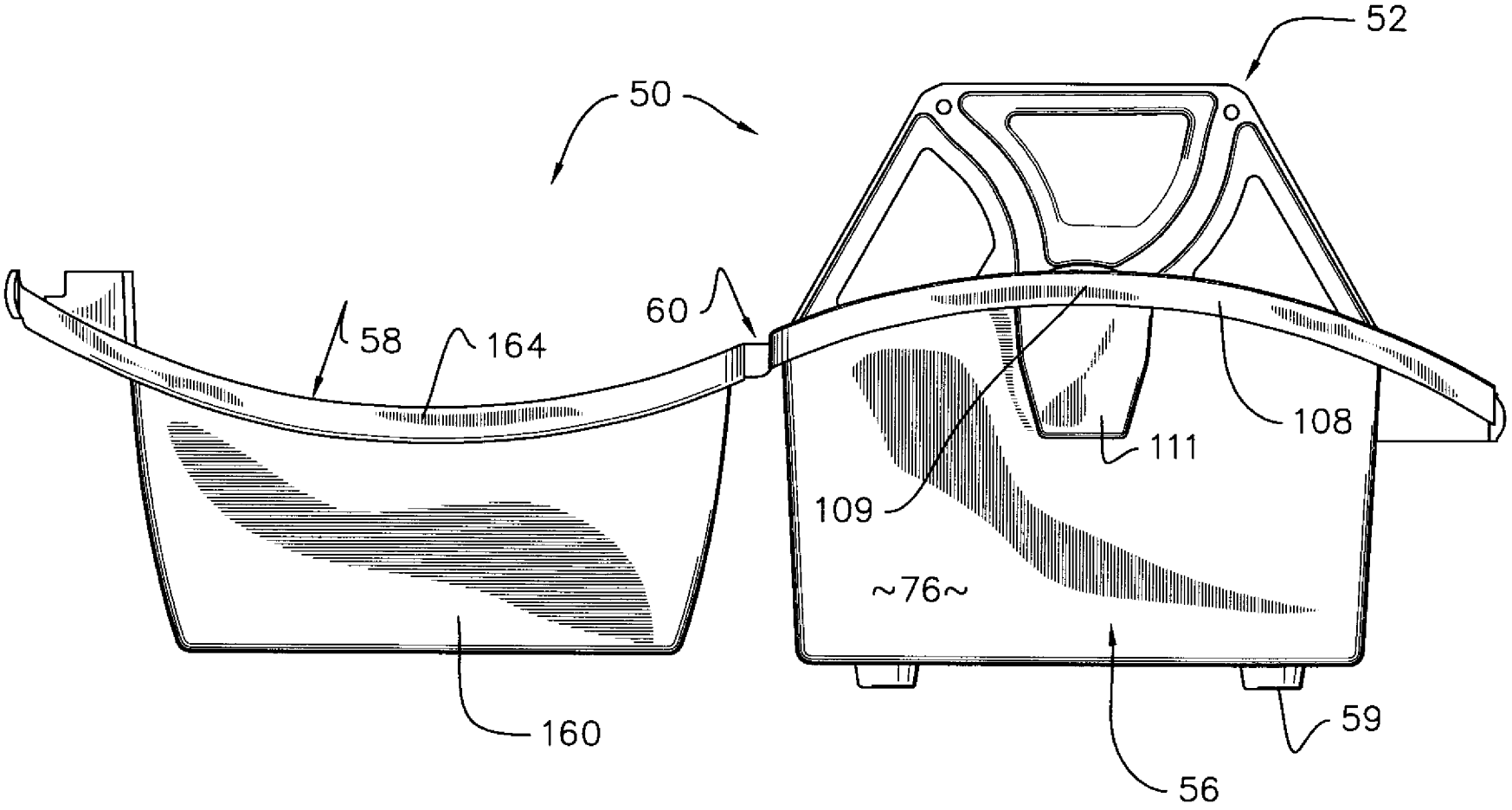
FIG. 15 is a left side elevational view of the loaded and opened caddy.

Each integral end panel 74, 76 (FIGS. 7, 8, 14, 15) of the base 56 also includes an upper peripheral ledge that extends from the rear hinge 60 to the front shelf 90 previously described. For example, left end panel 76 (FIG. 15) has a curved ledge 108 with the higher midpoint 109 centered on panel 76 and disposed above an outwardly projecting bearing housing 111. The opposite, spaced apart right end panel 74 (FIGS. 8, 14) has a complementary curved ledge 114 with a higher midpoint 115 centered on panel 74 above an outwardly projecting bearing housing 116. Ledges 108 and 104 can be utilized as lifting handles when the caddy 50 is closed. The bearing housings 111, 116 define interior gudgeons 111A and 116A respectively that mate with the spindles projecting from the reel 52 (FIG. 13) to rotatably mount the reel 52 as explained hereinafter. The plastic spindles (FIGS. 21-23) discussed later comprise hub portions seated within the receptive inner gudgeons 111A and 116A (FIG. 13) defined by the bearing housings 111, 116 when the reel 52 is disposed within caddy 50.

Figure 3:
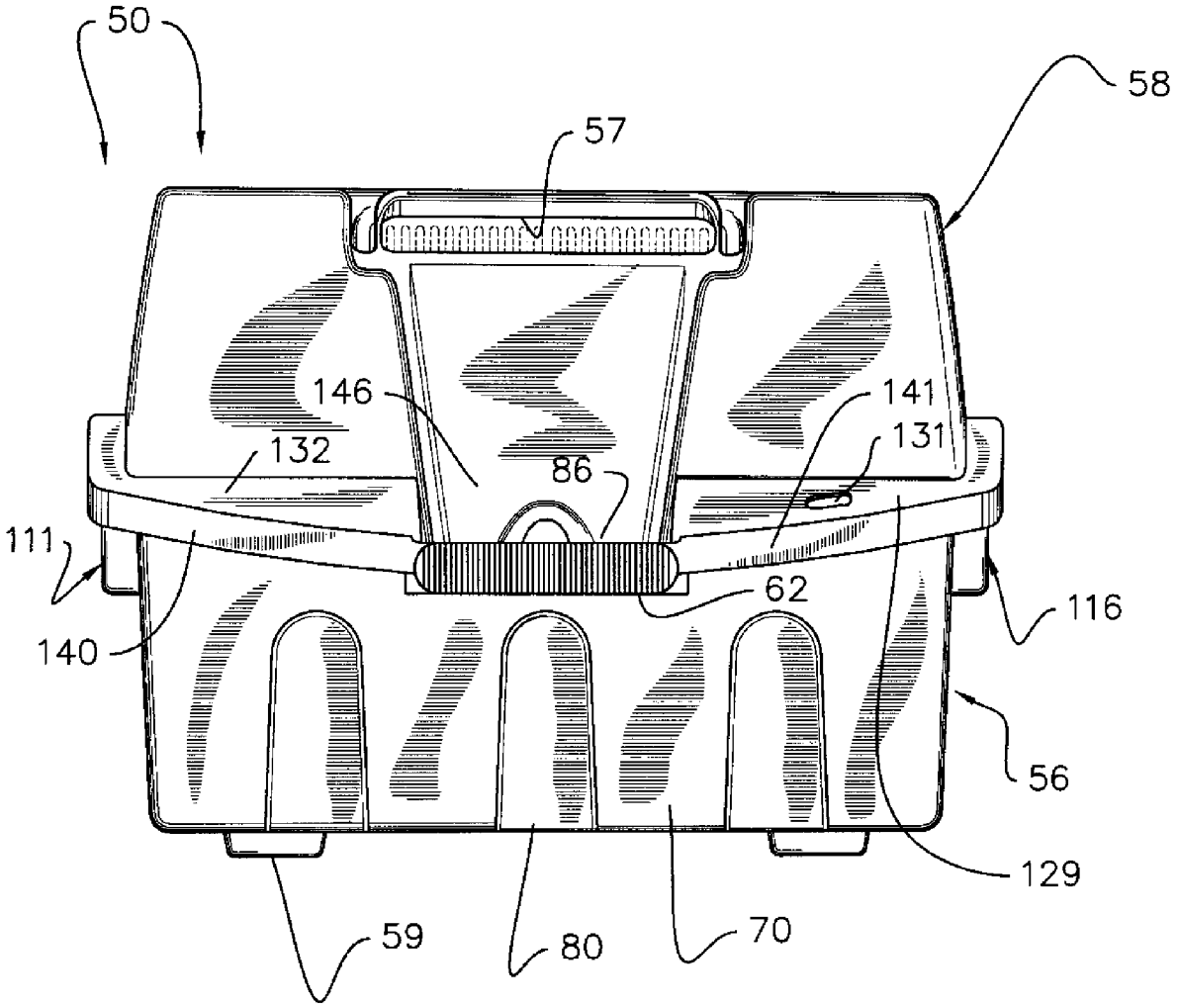
FIG. 3 is a front elevational view of the closed caddy.
Figure 4:
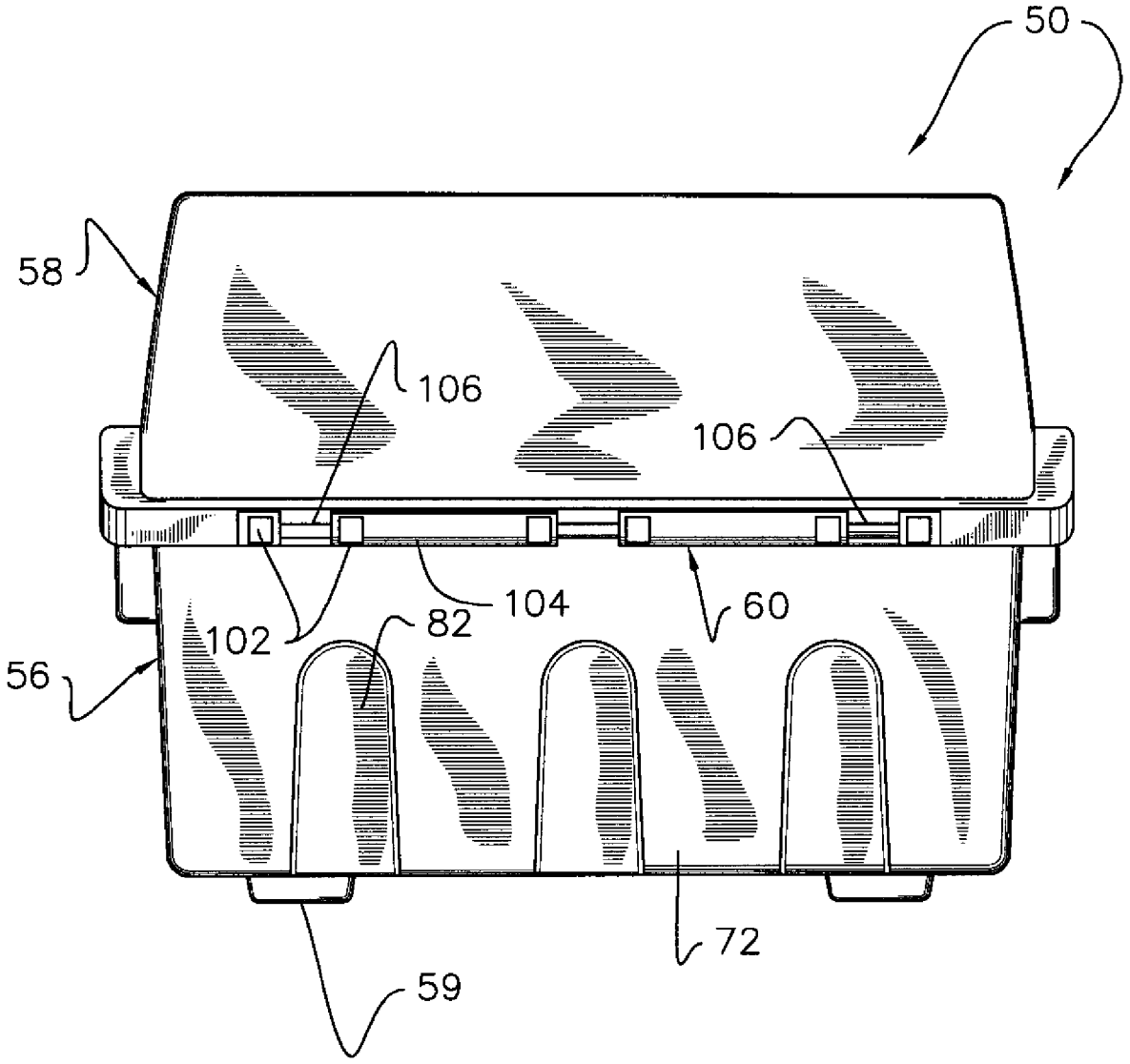
FIG. 4 is a rear elevational view of the closed caddy.
Figure 5:
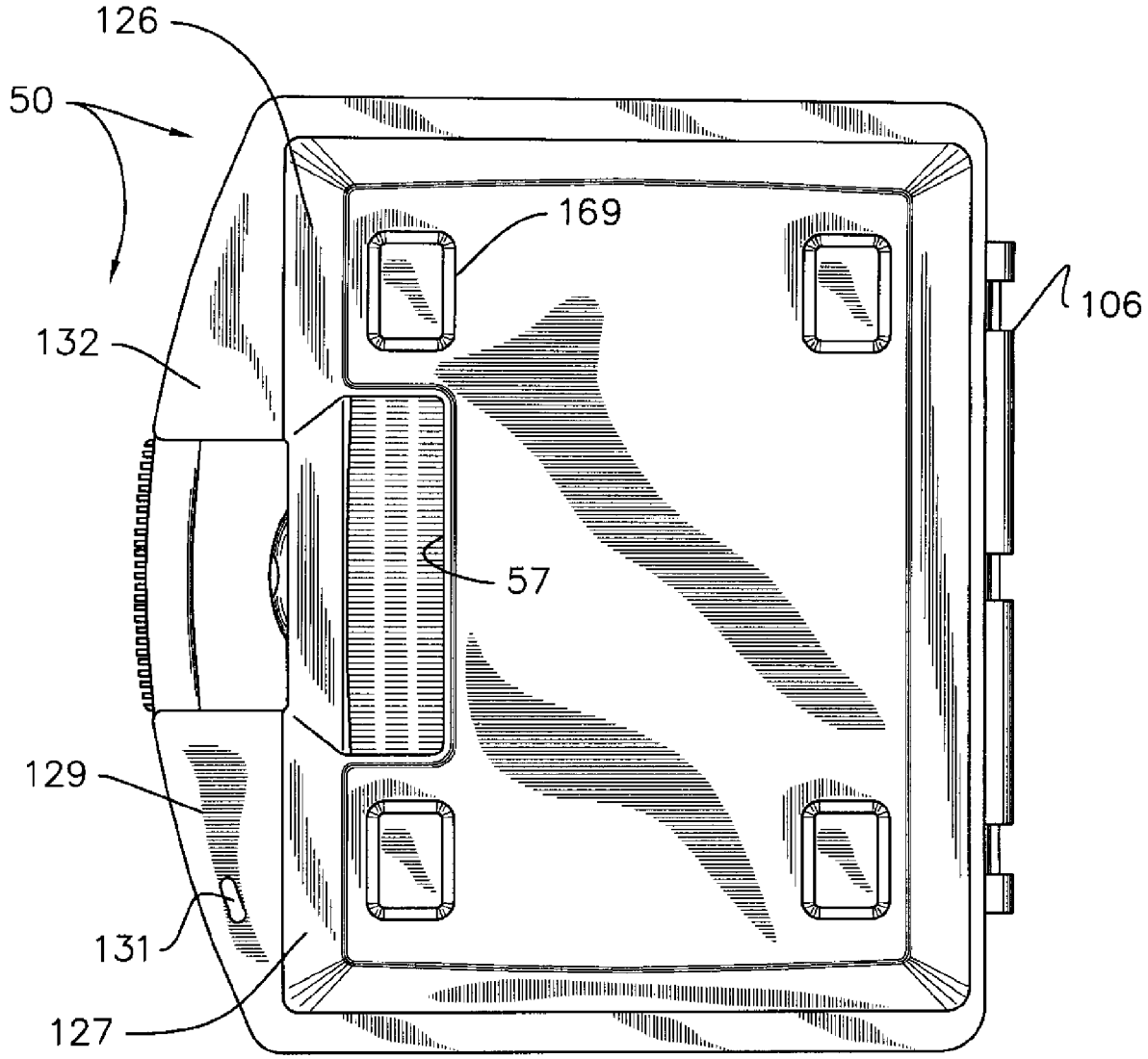
FIG. 5 is a top plan view of the closed caddy.

The caddy top 58 sits atop the base 56 and is pivoted thereto with hinge 60 at the rear as discussed earlier. Top 58 has a front panel 122 (FIGS. 1, 12) with a recessed center portion 124 disposed between integral side portions 126, 127 (FIG. 1). A complementary front ledge 129 projects outwardly from panel portion 127 and a similar opposite ledge 132 projects from panel 122 (FIGS. 1, 3). Preferably there is a wire end catch 131 defined in ledge 129 (FIGS. 1, 5) to temporarily hold loose wire ends. Peripheral borders 140, 141 form the front of ledges 132, 129 and are joined by a handle portion 146 which is part of handle 62. Borders 140, 141 are complementary with and substantially cover the projecting ledge 90 on the base 56 discussed earlier.

End panels 160 (FIG. 7) or 161 (FIG. 1) of the top 58 have arcuate peripheries 164, 162 (i.e., FIGS. 10, 14-15), respectively that mate with and are complementary to base side ledges 108 (FIG. 15) and 114 (FIG. 14) discussed above when the caddy 50 is closed. Importantly, the upper surface 166 (FIGS. 1, 2) of the top 58 has a plurality of generally cubicle indentations 169 disposed generally at the corners of the rectangular surface 166. Indentations 169 are aligned with the feet 59 (FIG. 4) in the base 56. Thus when caddies are vertically stacked atop one another, when for example two or more caddies are transported at the work site on a conventional hand truck or dolly, the feet 59 from an upper caddy can register with the indentations 169 in a lower unit to stabilize the vertical stack. Beneath the upper surface 166 of the top, at the underside 170 (FIG. 13) the indentations have projecting nubs 169B. When empty caddies are stacked in the open position for shipping, as discussed later, the indentations 169 (FIG. 2) in one caddy can register with the projecting indentations 169B (FIG. 13) in a lower stacked caddy for stability.

Figure 16:
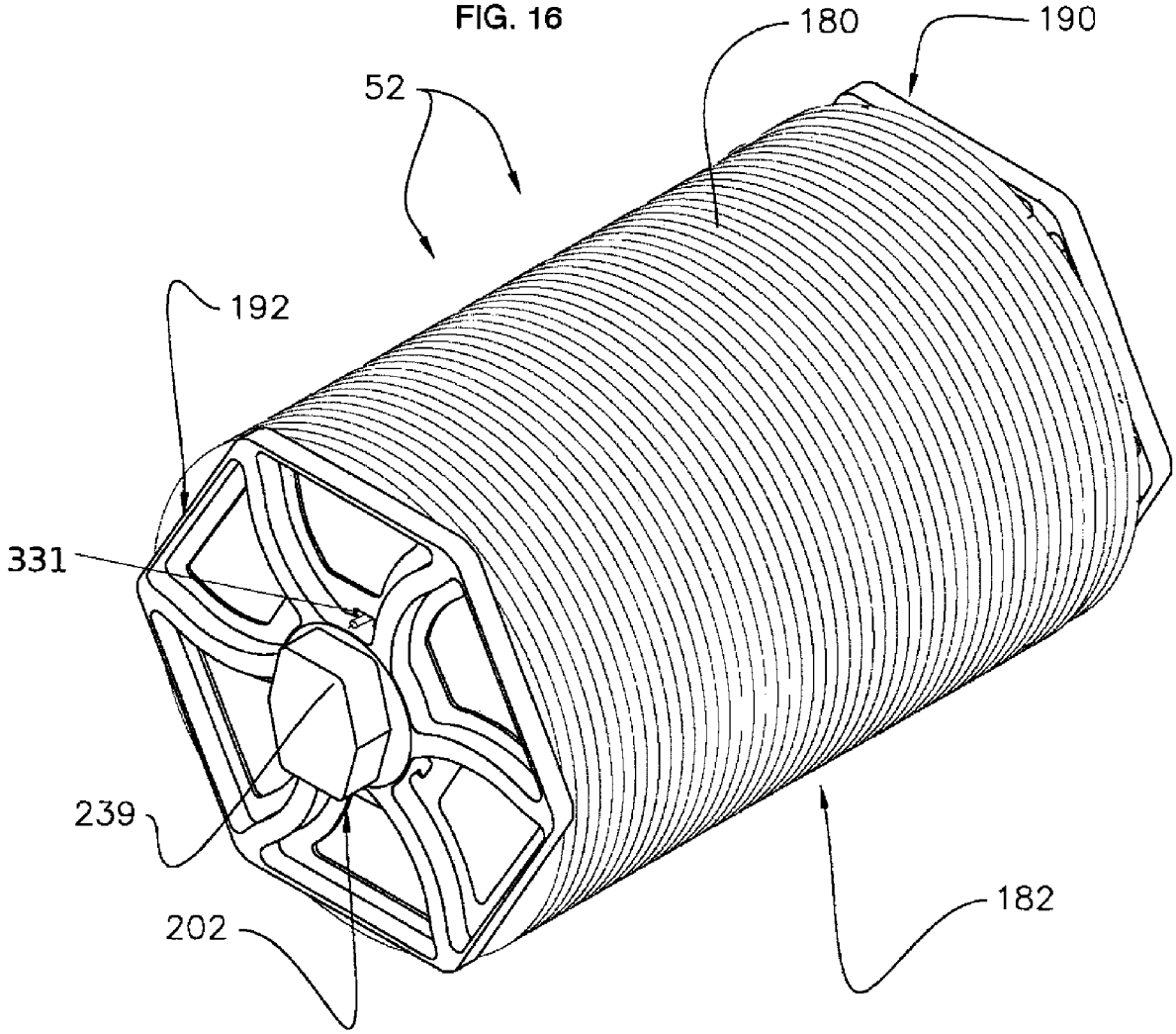
FIG. 16 is a right, frontal isometric view of a cable reel.
Figure 17:
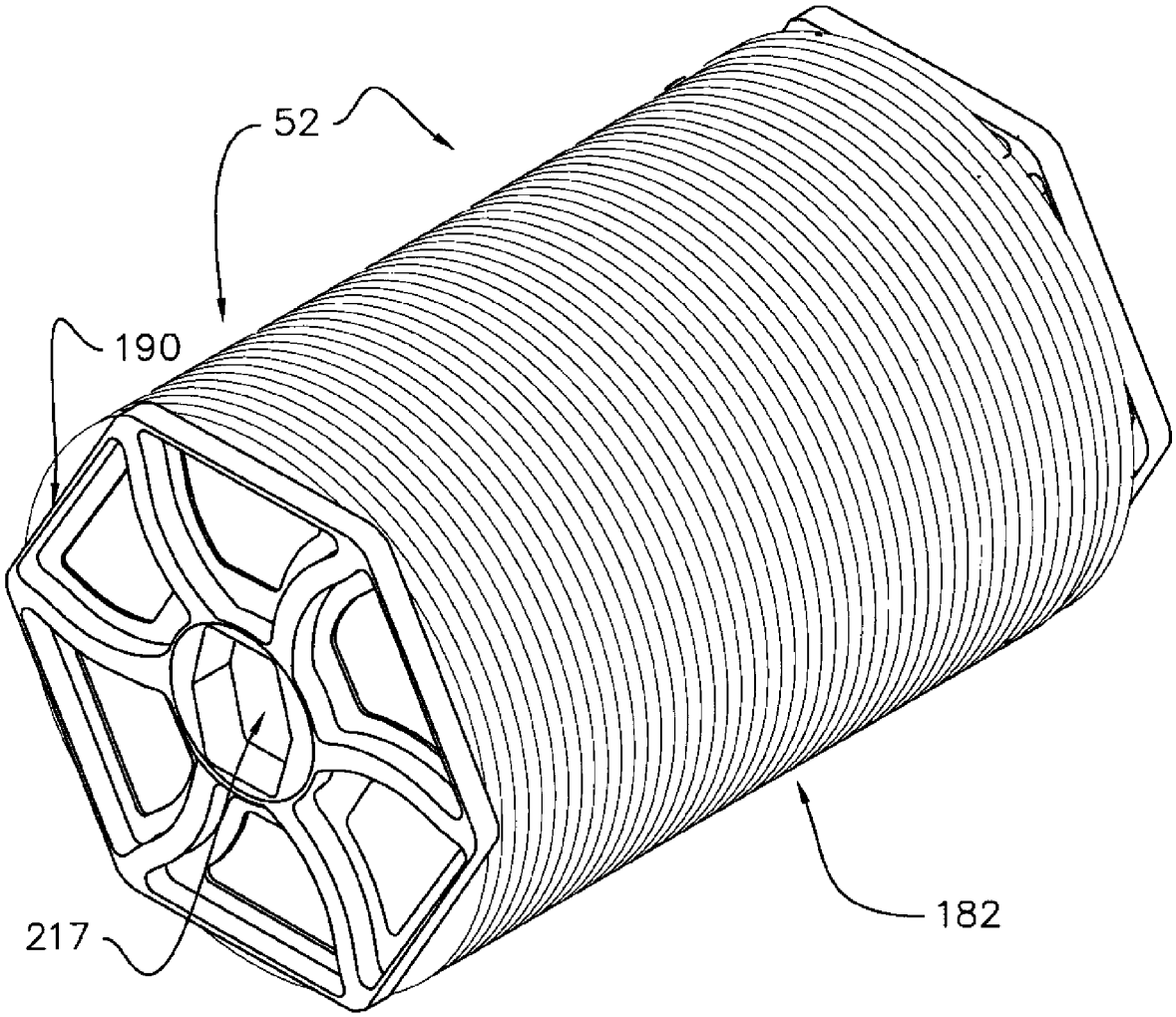
FIG. 17 is a left frontal isometric view of the cable reel.
Figure 18:
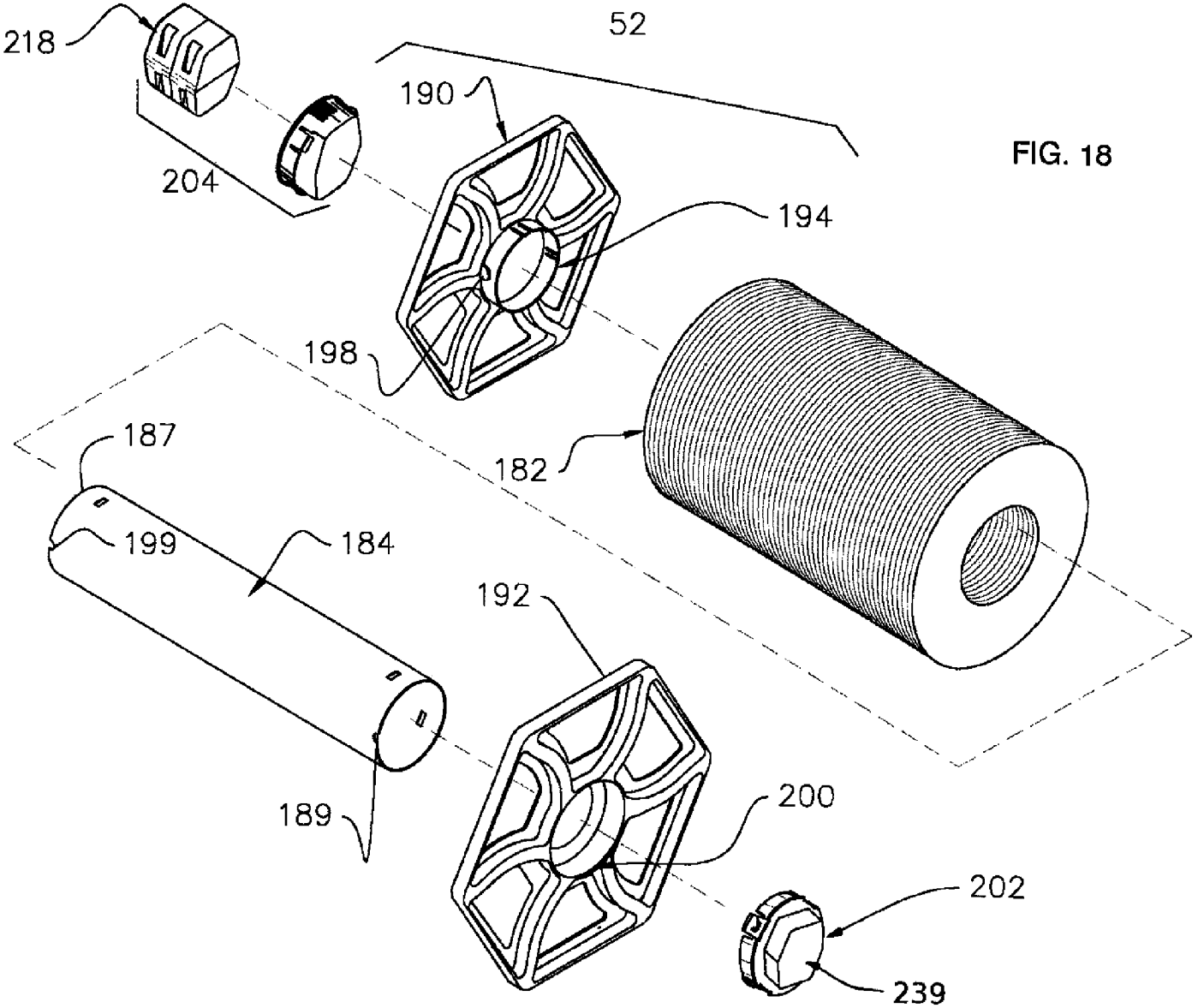
FIG. 18 is an exploded isometric view of the cable reel.

Referring now to FIGS. 16-18, wire or coaxial cable 180 is wound about and stored upon reels 52. Referring to FIG. 18, the reel 52 preferably comprises a spool 182 of cable 180 that is coaxially mounted by a central axle 184 when reels are mounted within a caddy 50. Opposite ends 187, 189 of axle 184 are coupled to similar, spaced apart end caps 190, 192 (i.e., FIGS. 18, 19). These flange-like end caps 190, 192 restrain wire, cable or other filamentary material wound about the spool 182 and enable rotation. The inner centers of each end cap include circular coupling rings 194 that mate with ends 187, 189 of axle 184 in assembly. The axle ends include projecting notches 199 that register with locks 198 in coupling rings 194. On their opposite outer ends, the coupling rings 194 have generally circular, recessed bearing races 200 (FIG. 18) to which spindles 202 or 204 may be fitted. A wire end slot 331 is shown in FIG. 16 and provides access to the starting end of the cable 180 on spool 182.

There are two spindles employed in a preferred embodiment, a unitary, single piece spindle 202, and a multi-piece spindle 204. Each preferably molded plastic spindle includes a bearing portion, and a hub. The spindle bearing portions are fitted to the end cap races 200 to journal the reel 52 for rotation. Spindle hub structures are supported within complementary gudgeons 116A or 111A (FIG. 13) respectively to support the associated reels 52 within the case and enable rotation. The inner axle 184 and end caps 190, 192 thus rotate relative to the spindle hubs to enable reel rotation.

Figure 18A:
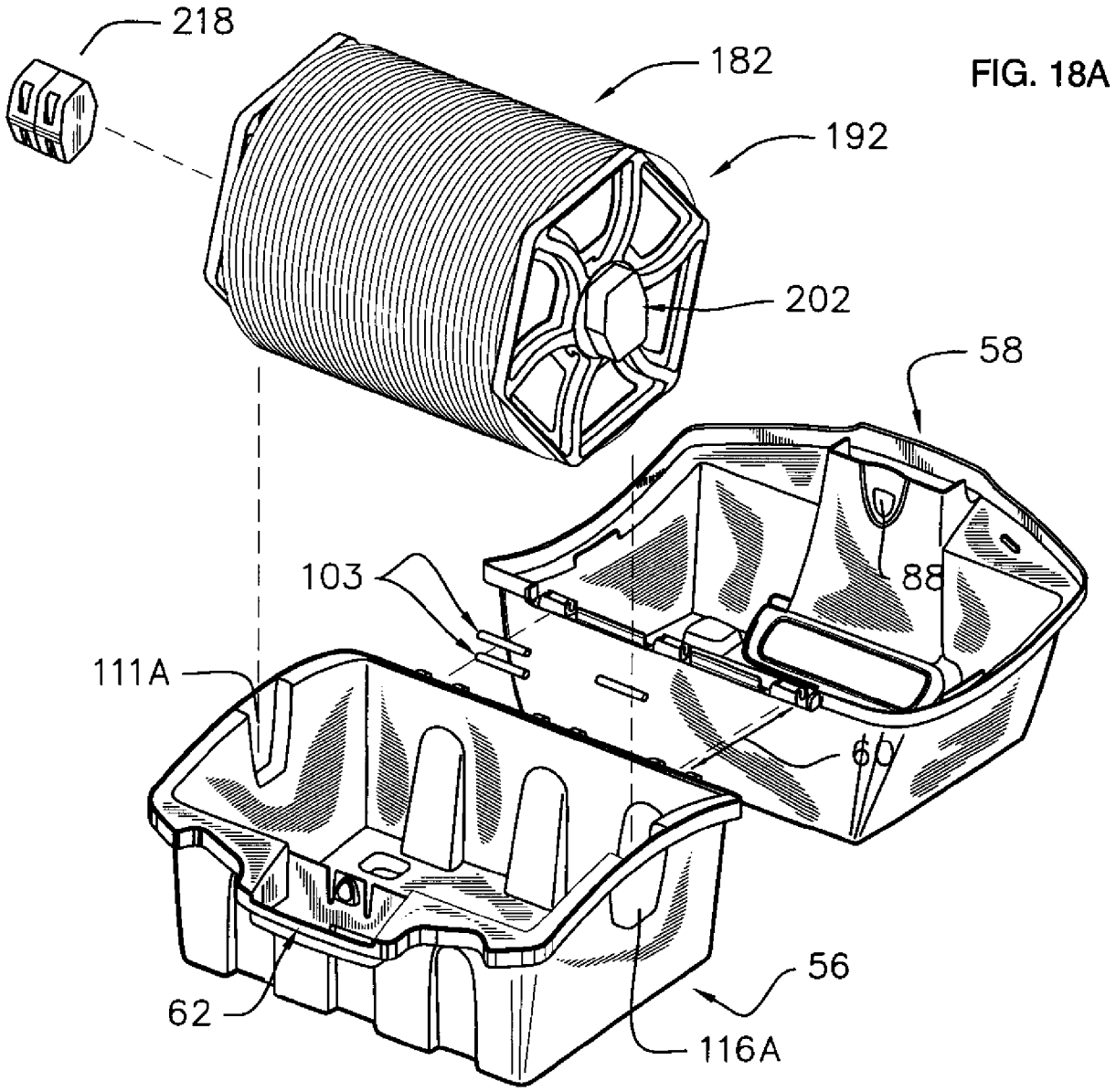
FIG. 18A is an exploded isometric view of a caddy and reel assembly.
Figure 19:
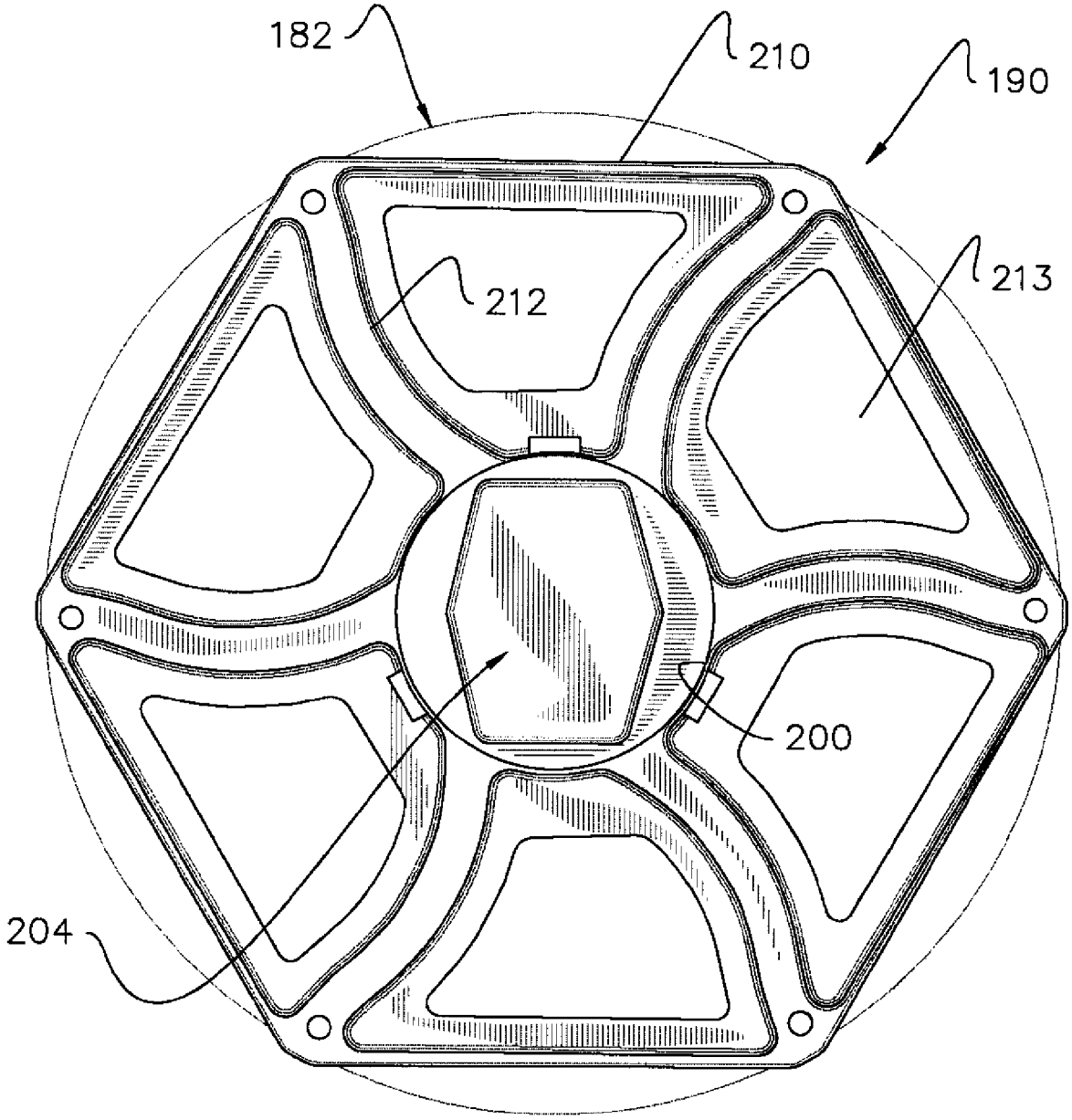
FIG. 19 is an enlarged plan view of a reel end cap.
Figure 20:
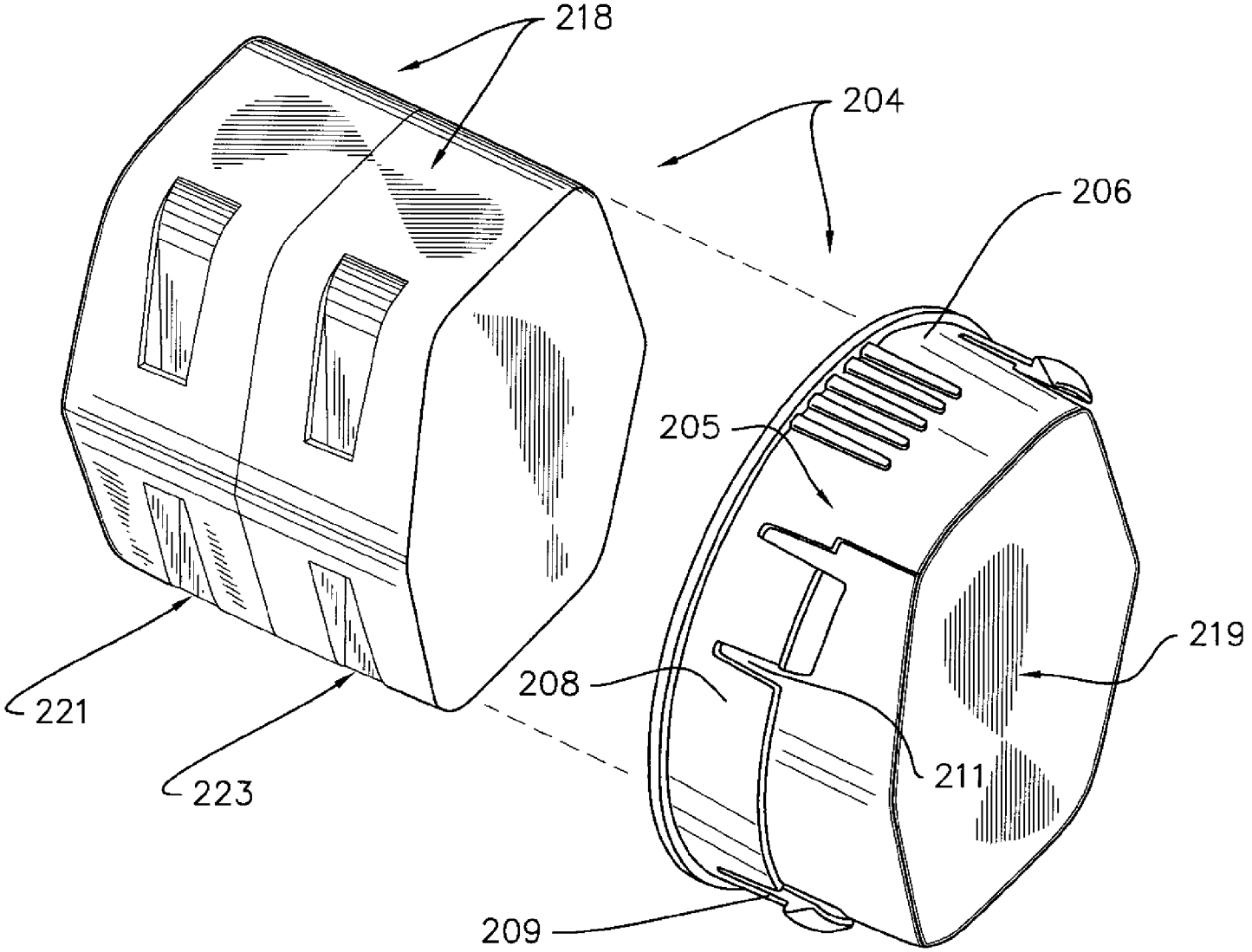
FIG. 20 is an enlarged, exploded isometric view of a multi-part spindle.
Figure 21:
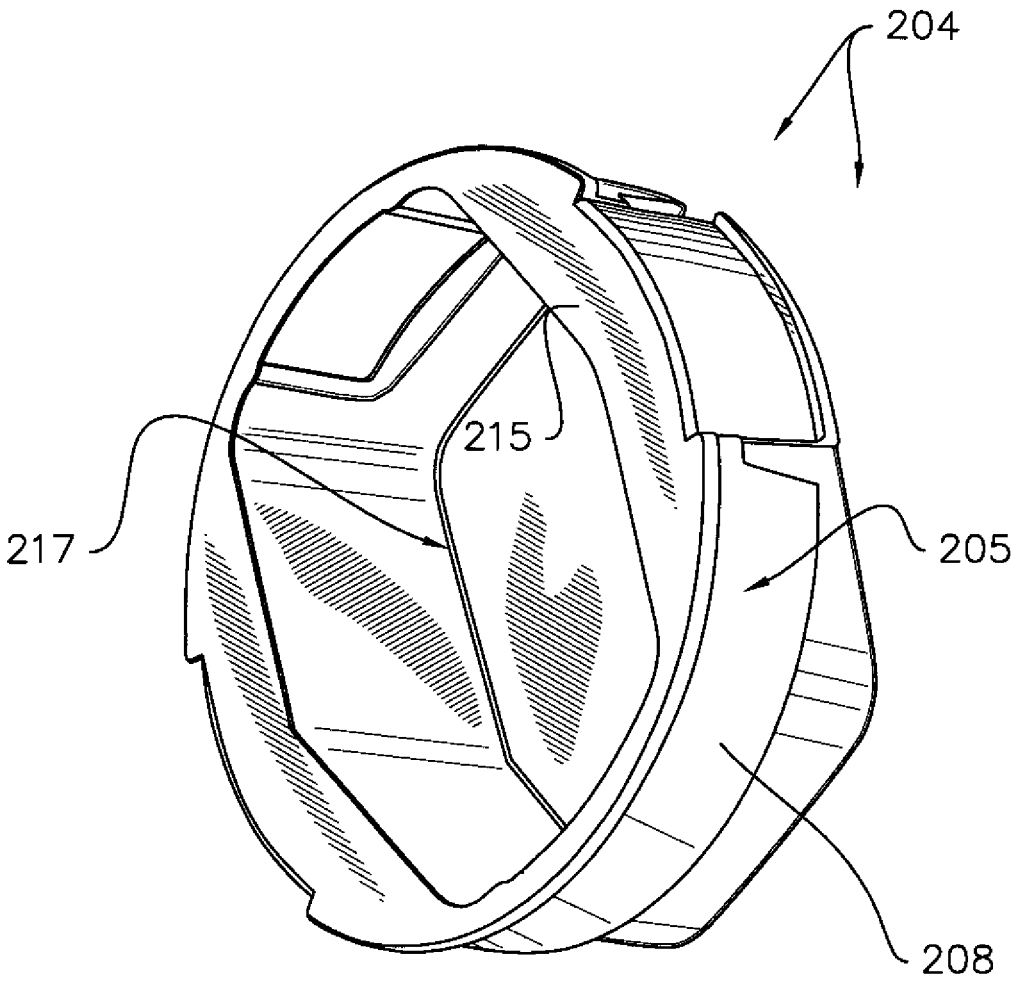
FIG. 21 is an enlarged, isometric view of the inside hub socket associated with the multi-part spindle of FIG. 20.

Referring to FIG. 19, a preferred embodiment of end cap 190 or 192 is detailed. Spindle 204 is seen mated within the coaxially centered race 200 of the end cap discussed above. Preferably each end cap is polygonal so that the reel is stable when placed on a substantially flat surface and will not roll away. In a preferred embodiment the end caps are either hexagonal or octagonal. Each of the outer facets 210 of the end cap are integral with curved and radially spaced apart spokes 212 that project from the inner hub of the end cap 190. Periodic radially spaced apart voids 213 lighten the end caps. The orientation of of spokes 212 and voids 213 add to the durability of the end cap 190 or 192 by allowing it to more flex on impact and thereby resist permanently deforming or breaking Referring mainly now to FIGS. 20 and 21, the preferably two-piece spindle 204 comprises a bearing portion 205 comprising a circular, peripheral bearing ring 206. Bearing ring 206 is segmented, comprising curved, peripheral portions 208, 209 that are separated by relief slots 211 to enable resilient bending. Ring 206 engages and yieldably frictionally fits into end cap race 200 (FIG. 19) forming the bearing connection, allowing the end cap and reel to rotate relative to the hub. In an embodiment of the invention, the width of bearing ring 206 in contact with end cap race 200 is preferably between one-half and one inches. The width of the bearing ring 206 is important in providing variable braking as cable is removed, for durability and to sufficiently support the weight of a full reel 52. Ring 206 is integral with a projecting cap portion 219 (FIG. 20) that interiorly defines a recessed socket 217 (FIG. 21) at its opposite end. A separate, removable key 218 (FIGS. 18, 18A, 20) is removably fitted to spindle bearing portion 205 (FIG. 20), being received within socket 217 (FIG. 21).

Key 218 (FIG. 20) comprises a pair of adjoining, preferably similarly shaped portions 221 and 223. The key's hub 221 is designed to seat within a gudgeon 111A in assembly when a reel is placed within the caddy. The neighboring plug 223 (FIG. 20) is adapted to fit within socket 217 provided by the spindle bearing portion 205 (FIGS. 20, 21). With a reel disposed within the caddy, the projecting key 218 now coupled to socket 217 by plug 223 projects its hub 221 towards bearing gudgeon 111A (FIG. 13). Alternatively, when reels are shipped from the factory, or when reels are moved or stored about a work site, the key 218 can be removed from spindle 204, exposing hub socket 217 (FIG. 21) that can now receive the hub 239 (FIGS. 18, 22) from a unitary spindle 202 projecting upwardly from another reel below it, as when multiple reels are vertically stacked. When reels are to be mounted in the caddy for use, the removable key 218 is reconnected to spindle 204 and seats within a gudgeon to establish reel rotation.

The "security key" 218 can be adapted to allow only specific reels to fit within a caddy. In other words, the configuration of the plug 223 (FIGS. 18, 20) can be matched to specific, complementary sockets 217 (FIG. 21), so that specific reels cannot be rotatably disposed within a caddy unless the user has a properly configured key 218 (i.e., the proper "key") to fit within the given socket 217. Alternatively, the design of the receptive case gudgeons 111A or 116A can be custom configured so that a given caddy will receive and mount only a specific reel with specifically configured keys 218, associated with spindled 204, or hubs 239 (FIG. 22) associated with spindle 202. As a result, specific reel designs can be custom defined for specific customers or specific jobs using specific caddies, enabling rapid identification, reducing mistakes, and reducing the likelihood of theft.

Figure 22:
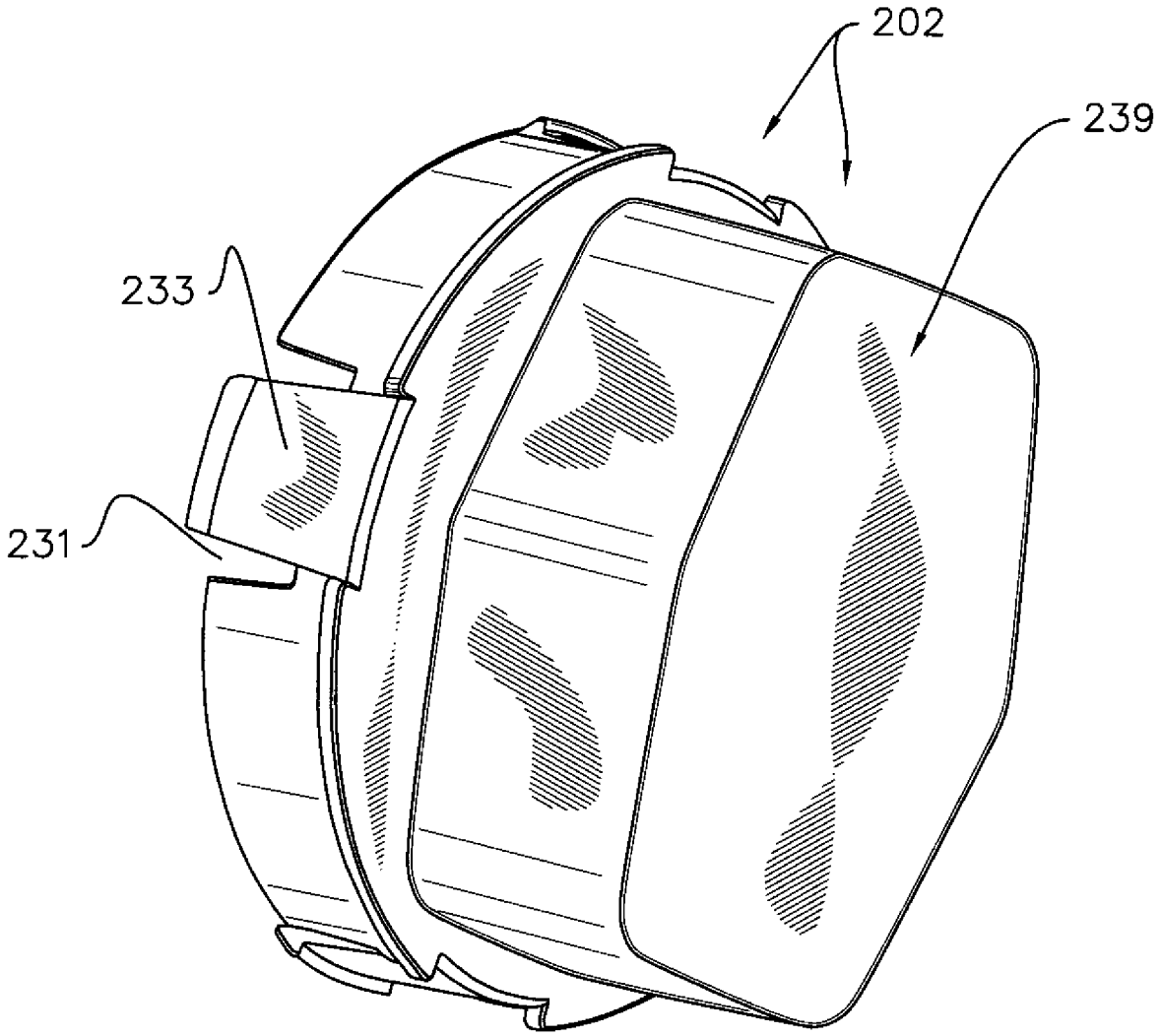
FIG. 22 is an enlarged isometric view of a unitary spindle.
Figure 23:
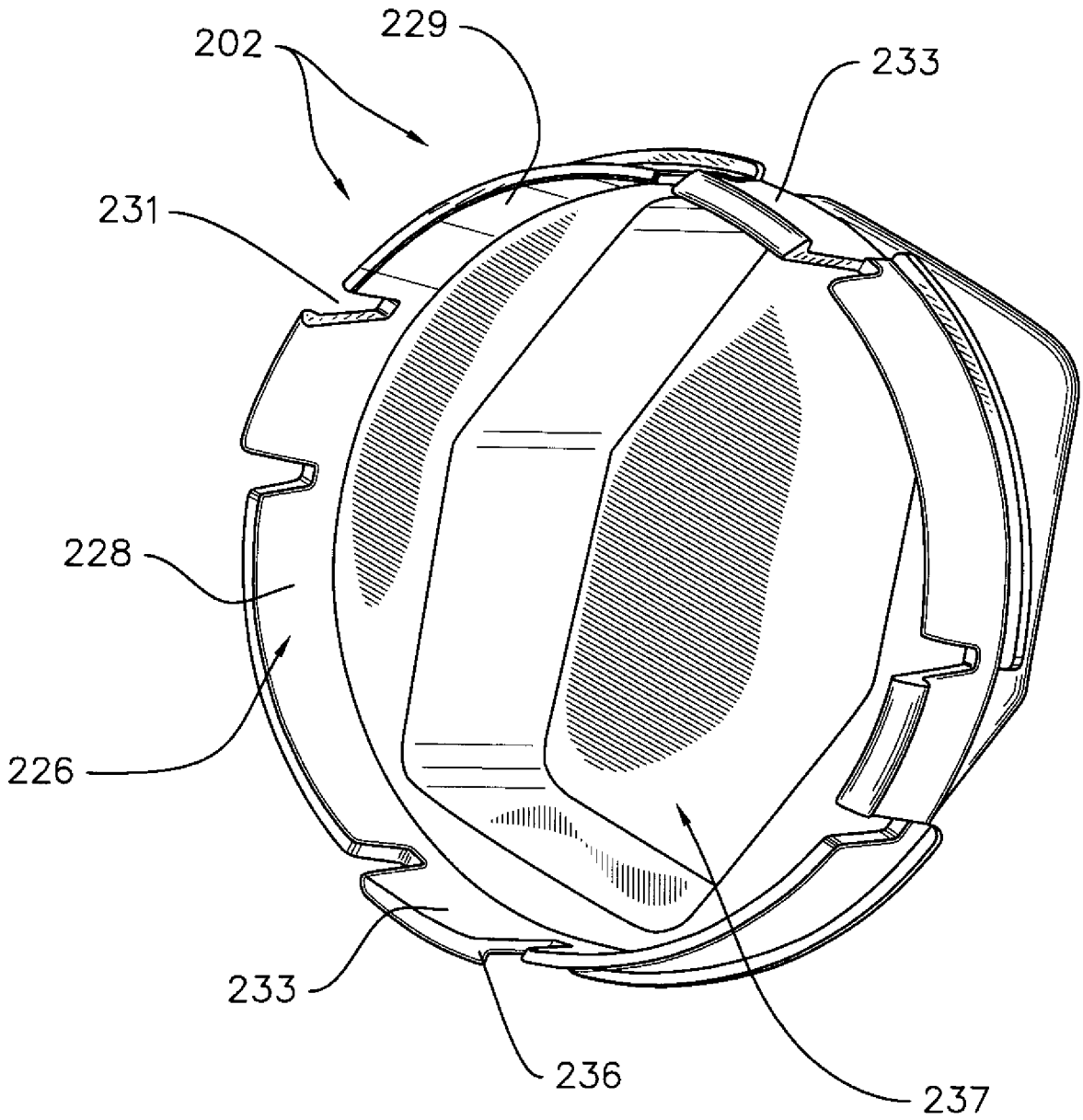
FIG. 23 is an enlarged isometric view of the spindle of FIG. 22, but showing the inside.

In FIGS. 22 and 23 the permanently attached, unitary spindle 202 is detailed. An integral, outer, peripheral bearing ring 226 is also segmented, comprising separated curved portions 228, 229 for example, that are separated by relief slots 231 to enable resiliency. The width of bearing ring 226 is preferably the same as the width of bearing ring 206. Preferably there are four radially spaced apart, barbed tabs 233 comprised of outwardly facing barbs 236 that engage with a inner lip of of the race 200 (FIG. 18) and snap into place. Barbs 236 axially lock the spindle 202 within the race 200 for rotation of the spindle. Thus bearing ring 226 journals the spindle for rotation. The resilient plastic construction enables yieldable frictional fitting of the spindle 202 to the end cap (FIG. 18) where it is permanently seated. Ring 226 borders a frontal, recessed interior 237. Recess 237 forms the underside of an integral projecting hub 239 (FIG. 22) at an opposite end that is normally seated within a caddy inner gudgeon 111A or 116A (FIG. 13) to enable reel rotation. The removable key 218 (FIG. 18) that is associated with spindle 204 may have its hub portion 221 geometrically configured similarly to hub portion 239 on spindle 202; however, both hub portions 221 and 239 have the same function, and both are seated within caddy inner gudgeons 111A and 116A. Alternatively, when reels are shipped or moved, hub portion 239 of a spindle 202 can engage another spool above it, nesting within an exposed socket 217 (FIGS. 18, 21) in another spindle 204 whose key 218 (FIG. 21) has been removed. Normally, hub portion 239 will seat within a gudgeon 116A (FIG. 13) when a reel is disposed within a caddy, and the spool can thus rotate relative to the hub and its receptive gudgeon.

Figure 24:
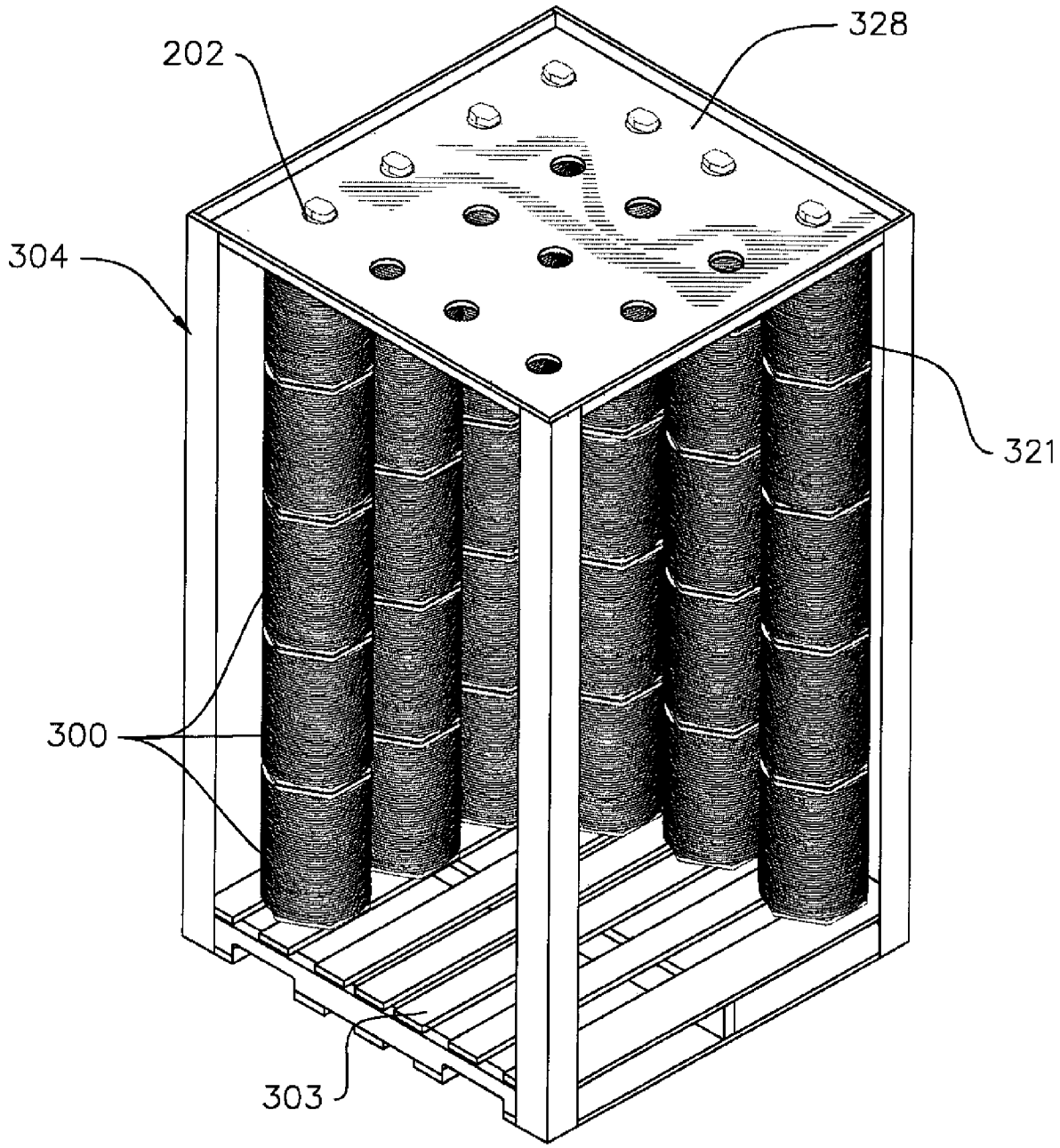
FIG. 24 is an isometric view showing a plurality of stacked reels on a pallet.

FIG. 24 illustrates how a plurality of separate reels 300 may be conveniently stacked in a pallet. Here the reels 300 are arranged in multiple, spaced-apart vertical stacks forming columns upon floor 303 of the pallet 304. For most of the reels, their upwardly projecting, permanent spindles 202 mate with upper reels. Specifically, the hubs 239 of spindles 202 fit within an exposed socket 217 (FIG. 21) that are unblocked and exposed by removal of the security key 218 of spindle 204 (FIG. 18) discussed earlier. However, the uppermost reels 321 (FIG. 24) have their spindles 202 seated within suitable spaced apart orifices defined in the roof 328 of pallet 304. FIG. 24 also illustrates how stability of the stacks is increased and volume required is decreased by the polygonal shape of reel endcaps 190 (FIG. 19) and 192 (FIG. 18A). The flat edge of the polygonal endcaps 190, 192 abut with a greater contact area than a circular shaped endcap.

Figure 25:
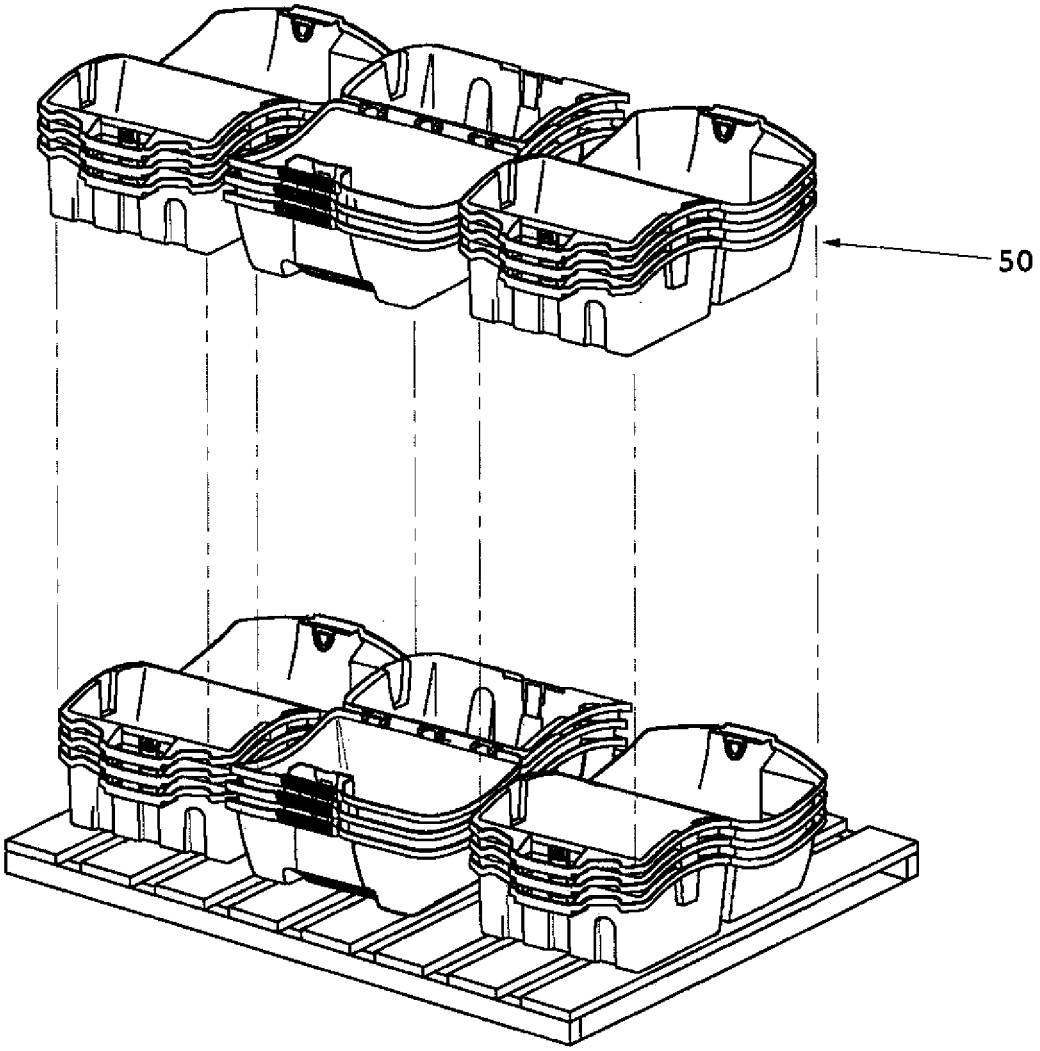
FIG. 25 is an isometric view showing a plurality of stacked and nested cases disposed on a pallet.

FIG. 25 illustrates how empty caddies 50 can be stacked for shipment. The caddies are opened as illustrated and stacked such that the lower base 56 of an upper unit is nested within the lower base of a lower unit. Similarly the top 58 of one unit, inverted by folding, is nested within the top of a similarly folded lower caddy. This minimizes shipping volume.

Figure 26:
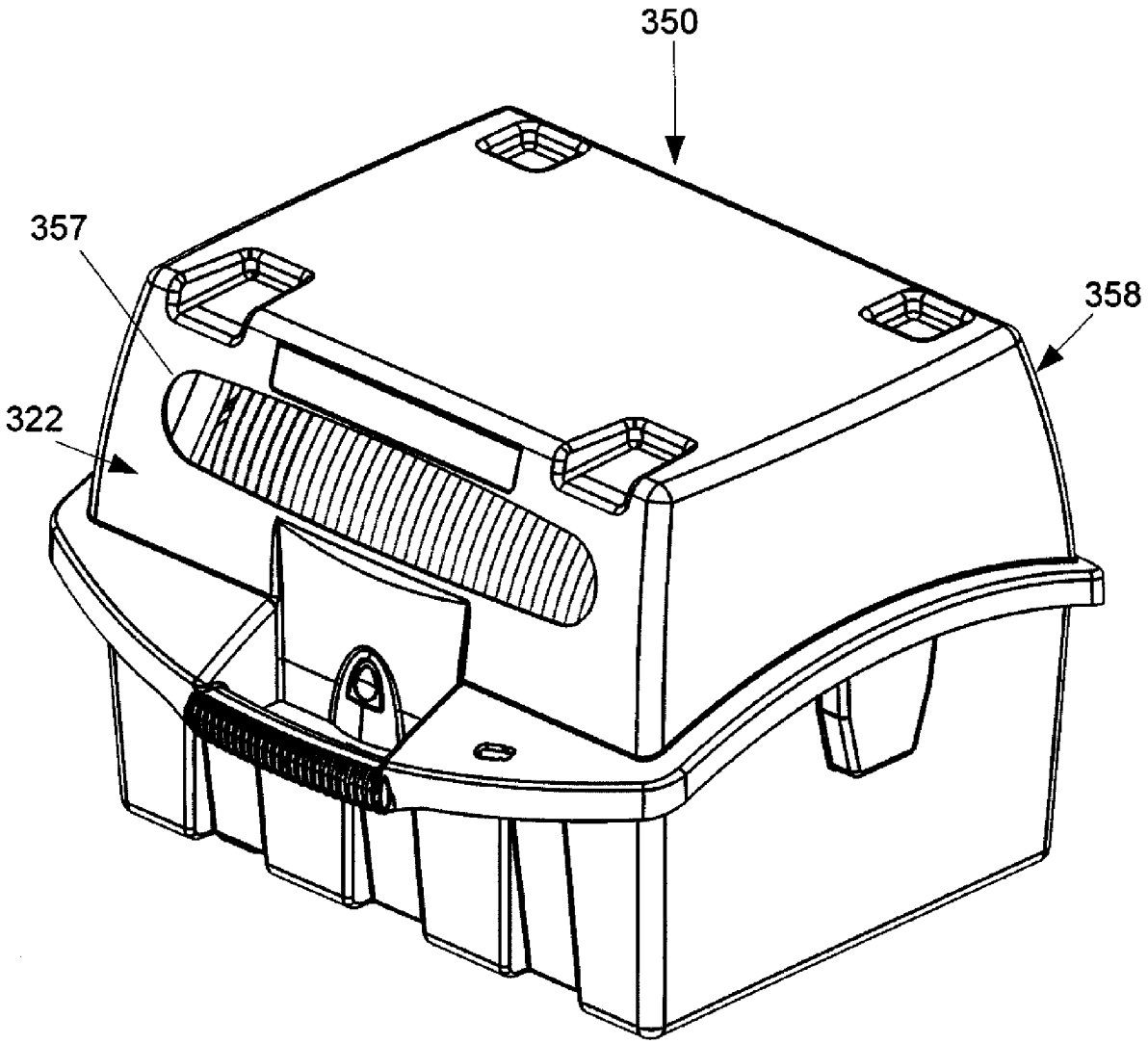
FIG. 26 is a frontal isometric view of an alternative embodiment of our cable reel caddy, with the caddy closed.

FIG. 26 shows an alternative embodiment of a portable caddy 350. Caddy 350 has an alternative top 358 and is otherwise similar to caddy 50 shown in FIG. 1. The caddy top 358 has a front panel 322 with a mouth 357. Mouth 357 is approximately centered on front panel 322 and extends preferably eighty percent of the width of front panel 322 and preferably fifty percent of the height of front panel 322. Other embodiments of mouth 357 may be larger or smaller.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A caddy system for enclosing, transporting and dispensing cable, the caddy system comprising:

a rectangular base and a top in an articulated clamshell arrangement;

the base adapted to be disposed upon a supporting surface, the base comprising integral front and rear panels, a pair of integral, spaced apart end panels, and an interior defined between said front and rear and end panels;

the top coupled to said base for enclosing said interior;

a gudgeon defined in each of said end panels; and, a reel adapted to be rotatably disposed within said base, the reel comprising an axle upon which said cable is wound wherein an axle length accommodates plural side-by-side cable windings and a pair of spaced apart end caps;

a pair of irrotatable spindles including a first spindle with an integral bearing ring portion, projecting hub, and barbed tabs for engaging a reel inner lip and a second multipiece spindle including a bearing portion and a key hub and key plug removably inserted therein of the bearing portion of the second multipiece spindle; and, each end cap having a central coupling ring therethrough including a coupling ring extension projecting toward the axle for mating with the axle and a race to one side of the extension for providing a bearing wherein the bearing portion of the second multipiece spindle comprises a socket; and the key hub for removably mating with the gudgeon and the key plug for removably mating with the socket.

2. The caddy system as defined in claim 1 wherein the axle extends coaxially through said cable between said end caps.

3. The caddy system as defined in claim 1 wherein axle ends include projecting notches that register with locks defined in said coupling rings.

4. The caddy system as defined in claim 1 wherein the key hub of the second multipiece spindle is configured to fit only within a specially configured one of the caddy gudgeons.

5. The system as defined in claim 1 wherein a button in said base mates with a similarly contoured, complementary opening formed in said top to form a latch to close said caddy system.

6. The system as defined in claim 1 wherein said top comprises a cable dispensing mouth.

7. A reel for transporting and dispensing cable, the reel adapted to be rotatably disposed within a container comprising an interior and a pair of spaced apart gudgeons, said reel comprising:

an axle upon which a spool of cable is wound wherein an axle length accommodate plural side-by-side cable windings;

within the container, a pair of spaced apart end caps coupled to said spool of cable;

the axle extending coaxially through said spool of cable between said end caps;

a pair of irrotatable spindles including a first spindle with an integral bearing ring portion, projecting hub, and barbed tabs for engaging a reel inner lip and a second multipiece spindle including a bearing portion and a key hub and key plug removably inserted therein of the bearing portion of the second multipiece spindle ; and, each end cap having a central coupling ring therethrough including a coupling ring extension projecting toward the axle for mating with the axle and a race to one side of the extension for providing a bearing wherein the bearing portion of the second multipiece spindle comprises a socket; and the key hub for removably mating with the gudgeon and the key plug for removably mating with the socket.

8. The reel as defined in claim 7 wherein axle ends include projecting notches that register with locks defined in said coupling rings.

9. The reel as defined in claim 8 wherein, when said reel is removed from said container, and said key hub of the second multipiece spindle is removed and the socket is exposed, the reel may be axially vertically stacked with other adjacent reels with a projecting hub from one of the adjacent reels engaging the exposed socket of the bearing portion of the multipiece spindle.

10. The reel as defined in claim 8 wherein said key hub of the second multipiece spindle is configured to fit only within a specially configured hub socket.

11. The reel as defined in claim 8 wherein said key hub of the second multipiece spindle is configured to fit only within a specially configured one of the gudgeons.

12. A package for containing cable, the package comprising:

a carrying caddy comprising a rectangular base adapted to be disposed upon a supporting surface, the base comprising integral front and rear panels, a pair of integral, spaced apart end panels, an interior defined between said front and rear and end panels, a top hinged to said base for enclosing said interior, and a gudgeon defined in each of said base end panels;

a reel adapted to be rotatably disposed within said base, the reel comprising an axle upon which said cable is wound and within the caddy a pair of spaced apart end caps coupled to said axle;

a pair of irrotatable spindle including a first spindle with an integral bearing ring portion, projecting hub, and barbed tabs for engaging a reel inner lip and a second multipiece spindle including a bearing portion and a key hub and key plug removably inserted therein of the bearing portion of the second multipiece spindle: and, each end cap having a central coupling ring therethrough including a coupling ring extension projecting toward the axle for mating with the axle and a race to one side of the extension for providing a bearing wherein the bearing portion of the second multipiece spindle comprises a socket; and the key hub for removably mating with the gudgeon and the key plug for removably mating with the socket.

13. The package as defined in claim 12 wherein each end cap comprises:

the coupling rings for irrotatably mating with axle ends; and one of the races engaged by the bearing ring portion of the first spindle or bearing portion of the second multipiece spindle.

14. The package as defined in claim 13 wherein said axle ends include projecting notches that register with locks defined in said coupling rings.

15. The package as defined in claim 14 wherein, when said reel is removed from said caddy, and said key hub of the second multipiece spindle is removed and the socket is exposed, the reel may be axially vertically stacked with other adjacent reels with the projecting hub of the first spindle engaging an exposed socket of one of the adjacent reels whose key hub has been withdrawn.

16. The package as defined in claim 14 wherein said key hub of the second multipiece spindle is configured to fit only within a specially configured one of the caddy gudgeons.

17. The package as defined in claim 14 wherein said key hub of the second multipiece spindle is configured to fit only within a specially configured hub socket.

18. A caddy system for enclosing, transporting and dispensing cable, the caddy system comprising:

a case and a removable reel installed therein, the reel including opposed first and second end caps spaced apart by a central axle;

the first and second endcaps having respective first and second central coupling rings that fixedly engage the axle;

a first spindle irrotatably supported by a first case gudgeon includes a bearing mated with the first coupling ring;

a second spindle includes a second bearing forming a socket that is removably mated with a user separable key; and, the key of the second spindle irrotatably supported by a second case gudgeon and the second bearing mated with the second coupling ring;

wherein the axle rotates about the spindle bearings when cable is pulled from the caddy and the spindles are removed from the gudgeons when the reel is lifted away from the case.

19. The caddy system of claim 18 wherein a bearing to coupling ring interengagement has a length of one-half inch or more for supporting the weight of cable loaded on the reel.

20. The caddy system of claim 18 including an end cap slot providing access to a starting end of the cable.

21. The caddy system of claim 18 wherein the case is in the form of a centrally divided rectangular box having a hinge along a first edge of the central division, a lower box half with opposed sides that are upwardly curved, and a handle formed along a second edge of the central division when the box is closed and the handle forming opposing handle grips when the box is opened.

22. The caddy system of claim 18 wherein the reel is designed for keyless stacking when a projecting hub of the first spindle of the reel interengages a socket of a spindle of another reel.

23. The caddy system of claim 18 wherein the reel is designed to spool one-thousand feet of RG-6 coaxial cable.

24. The caddy system of claim 18 wherein the end caps have multisided peripheries for protection against rolling when the reel is removed from the case.

* * * * *